US011864657B2

(12) United States Patent
Chen et al.

(10) Patent No.: US 11,864,657 B2
(45) Date of Patent: Jan. 9, 2024

(54) SOFA SEAT FRAME, SOFA BASE ASSEMBLY, SOFA AND SOFA PRODUCTION AND ASSEMBLY PROCESS

(71) Applicant: Remacro Technology Co., Ltd., Jiangsu (CN)

(72) Inventors: Weiming Chen, Jiangsu (CN); Xiaohong Li, Jiangsu (CN)

(73) Assignee: Remacro Technology Co., Ltd., Suzhou (CN)

( * ) Notice: Subject to any disclaimer, the term of this patent is extended or adjusted under 35 U.S.C. 154(b) by 271 days.

(21) Appl. No.: 17/259,929

(22) PCT Filed: Oct. 20, 2020

(86) PCT No.: PCT/CN2020/122039
§ 371 (c)(1),
(2) Date: Jan. 13, 2021

(87) PCT Pub. No.: WO2021/184750
PCT Pub. Date: Sep. 23, 2021

(65) Prior Publication Data

US 2022/0133047 A1 May 5, 2022

(30) Foreign Application Priority Data

Mar. 19, 2020 (CN) ..... 202010195198.9

(51) Int. Cl.
*A47C 4/02* (2006.01)
*A47C 17/16* (2006.01)
*A47C 7/30* (2006.01)

(52) U.S. Cl.
CPC ..... *A47C 17/163* (2013.01); *A47C 4/02* (2013.01); *A47C 4/028* (2013.01); *A47C 7/30* (2013.01)

(58) Field of Classification Search
CPC ..... A47C 7/30; A47C 4/028
See application file for complete search history.

(56) References Cited

U.S. PATENT DOCUMENTS 3,734,561 A * 5/1973 Barecki ..... A47C 3/00 297/DIG. 2
6,447,067 B1 * 9/2002 Williams ..... A47C 13/005 297/184.11

(Continued)

FOREIGN PATENT DOCUMENTS

CN 201022532 Y * 2/2008 ..... A47C 13/005
CN 101879014 A 11/2010

(Continued)

*Primary Examiner* — Timothy J Brindley

(57) ABSTRACT

The invention discloses a sofa seat frame, a sofa base assembly, a sofa and a sofa production and assembly process, the sofa seat frame comprises two cross beams arranged at intervals and two longitudinal beams connecting the two cross beams, wherein a plurality of supporting elastic pieces are arranged between the two cross beams; and each longitudinal beam comprises a first supporting plate for supporting a seat cushion and a first side plate arranged at one side of the lower part of the first supporting plate and used for being detachably connected with sofa fabric on the seat cushion. In the sofa seat frame provided by the invention, when the seat cushion is placed on the supporting elastic pieces, the first supporting plates can give a certain supporting force to the seat cushion, so as to improve the sitting comfort of users.

16 Claims, 14 Drawing Sheets

(56) References Cited

U.S. PATENT DOCUMENTS

| | | | | |
|---|---|---|---|---|
| 11,484,122 | B2 * | 11/2022 | Chen | A47C 4/02 |
| 2017/0119162 | A1 * | 5/2017 | Bullard | A47C 7/30 |

FOREIGN PATENT DOCUMENTS

| | | | | |
|---|---|---|---|---|
| CN | 208709076 | U | 4/2019 | |
| CN | 110101245 | A | 8/2019 | |
| CN | 209269083 | U | 8/2019 | |
| CN | 110731643 | A | 1/2020 | |
| DE | 0595310 | A1 * | 5/1994 | |
| DE | 202010000476 | U1 * | 7/2010 | A47C 3/00 |
| DE | 202010006947 | U1 * | 9/2010 | A47C 4/02 |
| EP | 2324737 | A1 * | 5/2011 | A47C 13/005 |
| WO | WO-2017123177 | A1 * | 7/2017 | |

* cited by examiner

SOFA SEAT FRAME, SOFA BASE ASSEMBLY, SOFA AND SOFA PRODUCTION AND ASSEMBLY PROCESS

FIELD OF THE INVENTION

The invention relates to the technical field of furniture, in particular to a sofa seat frame, a sofa base assembly, a sofa and a sofa production and assembly process.

BACKGROUND OF THE INVENTION

As we all know, the furniture industry has always been a labor-intensive traditional industry, especially the sofa industry. Its production process requires a lot of manual labor and production materials. For the sofa, the bearing capacity of the sofa determines the service life of the sofa, while the sofa base assembly determines the bearing capacity of the sofa to a large extent. At present, the sofa base assembly is generally composed of a rack and a sofa seat frame detachably connected to the rack.

Among them, sofa seat frames made of solid wood are the most common. When a wooden seat frame is made, a framework is first set up with solid wood in a wood factory, and hooks for connecting supporting elastic pieces are installed on the wooden framework, and the hooks are fixed on the wooden framework by means of rivets or screws, etc. After the wooden framework is made, the framework is transported to a sofa assembly workshop. In the sofa assembly workshop, the supporting elastic pieces are installed on the wooden framework to obtain the wooden seat frame. Subsequently, the wooden seat frame and the wooden or iron rack are assembled to obtain a sofa base assembly; then the seat cushion is placed on the supporting elastic pieces and is wrapped with sofa fabric, and the fabric is fixed to the wooden seat frame by rivets, thus completing the assembly of the seat cushion part. Therefore, the sofa seat frame made of a solid wood material is not only light in weight but also easy to process, since the sofa can be assembled by a traditional manual production line, the sofa seat frame made of the solid wood material is suitable for sofa production technology in traditional furniture industry.

However, the sofa seat frame made of the solid wood material has the following defects: first, the supporting strength of the wooden seat frame is not enough, so that the wooden seat frame is easy to damage after being used for a period of time and has a short service life; second, due to the material reason, the wood needs to be tested in import and export trade, and when single pieces that do not meet the requirements are found during sampling inspection, the whole batch needs to be stranded or repatriated, which is not conducive to international trade; third, the connection process between the wooden seat frame and the iron rack is complicated and the connection stability is poor; fourth, due to the different materials of the wooden seat frame and the iron rack, they need to be produced in different workshops, which not only has a higher cost, but also increases the transportation distance, resulting in low installation efficiency; fifth, rivets are usually used to connect the seat cushion fabric and the wooden frame, so that the fault tolerance rate is low, if there is an assembly error, it is difficult to rework, thus causing waste of a large amount of materials; and sixth, there are many manual manufacturing processes for the wooden seat frame, which is not conducive to standardized production and has difficulty in maintaining the unity of sofa quality.

In view of various defects of the wooden seat frame, some powerful furniture enterprises have begun to try to use metal materials to make the sofa seat frame. Compared with the wooden seat frame, a sofa seat frame made of a metal material has higher supporting strength and a longer service life. However, at present, the metal seat frame on the market still has the problems of complex structure, many parts and troublesome assembly. As disclosed in a Comparative Document 1 (Publication Number: CN110101245A), the frame comprises two symmetrically arranged longitudinal beams and two cross beams for connecting the two longitudinal beams. The cross section of the longitudinal beam is L-shaped and comprises a vertical plate and a transverse plate, wherein the vertical plate and the transverse plate define a containing cavity, and the two cross beams are symmetrically arranged on the folded edges at two ends of the longitudinal beam and are located in the containing cavity. In addition, the frame also comprises at least one supporting beam which connects the two cross beams. Although the sofa seat frame in the Comparative Document 1 reduces the manufacturing materials and weight, it has more parts and is troublesome to assemble. At the same time, the longitudinal beam with the L-shaped cross section not only has low supporting strength, but also is prone to deformation. In addition, since a containing cavity is defined by the vertical plate and the horizontal plate on the longitudinal beam, when the seat cushion is placed on the sofa seat frame, the two sides of the seat cushion are not supported correspondingly. When the seat cushion is squeezed, the two sides are easy to collapse, so it is also necessary to process the sponges on the two sides of the seat cushion, which not only wastes materials but also increases the processing procedures. Finally, the seat cushion fabric cannot be directly connected with the metal seat frame by riveting with rivets, which is more troublesome.

In addition, the connection mode between the metal seat frame and the rack currently on the market also has the problems of insufficient supporting strength and the like. As disclosed in a Comparative Document 2 (Publication Number: CN101879014A), a sofa frame convenient for disassembly and assembly and small in transportation volume is disclosed, wherein a seat frame in the sofa frame is provided with a connecting slot, and a first rack body and a second rack body in the sofa frame are respectively provided with positioning clamping slots. In addition, the sofa frame also comprises a clamping and fixing unit, and the two ends of the clamping and fixing unit are respectively clamped in the positioning clamping slots of the first rack body and the second rack body and the connecting slot of the seat frame so as to realize the connection of the seat frame with the first rack body and the second rack body. Although the sofa frame in the Comparative Document 2 does not adopt threaded or complicated connection structures, and can be easily assembled and disassembled without any assembly tools with relatively high efficiency, the buckling clamping method is adopted, the force bearing mode between the seat frame and the rack is point-to-point or line-to-line, and the acting force at the joint is relatively large. At the same time, the supporting strength given by the rack body to the seat frame is also low, and damage is easy to occur.

To sum up, there are still many problems in the sofa seat frames made of metal materials on the market. Therefore, in order to adapt to the globalized furniture market, it is necessary to adjust the sofa industry chain and improve the structure and technology of the sofa seat frame, the sofa base assembly and the sofa so as to control the quality and production cost of the sofa and realize the standardized and automatic production of the sofa.

SUMMARY OF INVENTION

In order to overcome the at least one defect in the prior art, the invention provides a sofa seat frame, a sofa base assembly, a sofa and a sofa production and assembly process.

The technical solution adopted by the invention to solve the above problem is as follows:

a first aspect of the invention provides a sofa seat frame which comprises two cross beams arranged at intervals and two longitudinal beams connecting the two cross beams, wherein:

a plurality of supporting elastic pieces are arranged between the two cross beams; and each longitudinal beam comprises a first supporting plate for supporting a seat cushion and a first side plate arranged at one side of the lower part of the first supporting plate and used for being detachably connected with sofa fabric on a seat cushion.

According to the sofa seat frame provided in the first aspect of the invention, a supporting structure for supporting the seat cushion can be formed by the plurality of supporting elastic pieces arranged between the two cross beams. As each longitudinal beam is provided with the first supporting plate, when the seat cushion is placed on the supporting structure, the first supporting plates can also give a certain supporting force to the seat cushion, thus improving the sitting comfort of users. In addition, when the sofa fabric is assembled, it is only necessary to install a clamping strip at the edge of the sofa fabric, and then clamp the clamping strip with the lower edges of the first side plates of the longitudinal beams to fix the sofa fabric on the seat cushion to the sofa seat frame. The process is simple and convenient, not only improves the installation efficiency, but also facilitates disassembly, has a high fault tolerance rate and cannot cause material waste.

Further, each longitudinal beam is a metal piece and comprises the first side plate, a second side plate arranged at a distance from the first side plate and located on the other side of the lower part of the first supporting plate, and the first supporting plate connecting the first side plate with the second side plate from the top of the first side plate and the top of the second side plate.

Therefore, by arranging the second side plates, not only is the overall structure of the longitudinal beams stabler, but also the firmness of the connection with the cross beams and a bottom rack is improved, thus improving the overall stability of the sofa seat frame and increasing the supporting strength of the sofa seat frame.

Further, the sofa seat frame also comprises first connecting pieces for connecting a sofa rack, each first connecting piece comprising two fifth side plates arranged at intervals and a third supporting plate connecting the bottoms of the two fifth side plates, wherein:

the third supporting plate is connected with the sofa rack; and one fifth side plate is connected to the first side plate of the longitudinal beam, and the other fifth side plate is connected to the second side plate of the longitudinal beam.

Therefore, by arranging the plurality of first connecting pieces on the sofa seat frame, the installation efficiency between the sofa seat frame and the sofa rack can be improved. In addition, as each first connecting piece is provided with the third supporting plate, the supporting area of the joint between the sofa seat frame and the sofa rack is increased, the supporting strength of the sofa rack to the sofa seat frame is further improved, and the sofa seat frame is stabler and firmer.

Further, the third supporting plate and the two fifth side plates are integrally formed by bending, and are U-shaped.

Therefore, the first connecting piece integrally formed by bending has higher supporting strength and is convenient to process. In addition, the first connecting piece is arranged in a U shape, which not only makes the structure of the first connecting piece stabler, but also has higher connection stability with the sofa rack due to the flat bottom, thus further improving the supporting strength of the sofa rack to the sofa seat frame.

Further, the first side plate, the second side plate and the first supporting plate are integrally formed by bending, and are inverted U-shaped.

Therefore, the longitudinal beam integrally formed by bending has higher supporting strength and is convenient to process. In addition, the longitudinal beam is arranged in an inverted U shape, so that the structure of the longitudinal beam is stabler and the supporting strength is higher, thus improving the overall supporting strength of the sofa seat frame.

Further, the first supporting plate is provided with a reinforcing rib.

Therefore, the arranged reinforcing rib can enhance the strength of the longitudinal beam and make the structure of the longitudinal beam stabler.

Further, the two cross beams are each provided with a plurality of hooks integrally formed by stamping; one ends of the supporting elastic pieces are connected to the hooks on one cross beam, and the other ends of the supporting elastic pieces are connected to the corresponding hooks on the other cross beam.

Therefore, the hooks formed by stamping have higher strength than the existing hooks welded or connected to a cross beam through other forms, and are less likely to be damaged under the pulling action of the supporting elastic pieces, thus prolonging the service life of the sofa seat frame, simplifying the assembly process and omitting the step of welding the hooks.

Further, each hook is provided with a protrusion for preventing unhooking of the supporting elastic piece.

Therefore, the protrusion can not only prevent the supporting elastic piece from being separated from the hook in the use process, but also avoid bending the end of the supporting elastic piece to reinforce the connection with the hook when the supporting elastic piece is hooked, thus reducing the assembly steps and improving the assembly efficiency.

Specifically, the supporting elastic piece is a serpentine spring.

Further, each cross beam is a metal piece and comprises a second supporting plate, a third side plate arranged on the outer side of the lower part of the second supporting plate and used for being detachably connected with the sofa fabric on the seat cushion, and a fourth side plate arranged on the inner side of the lower part of the second supporting plate, wherein:

a plurality of hooks on each cross beam are formed by stamping the second supporting plate and the fourth side plate.

Therefore, when the sofa fabric is assembled, it is only necessary to install the clamping strip at the edge of the sofa fabric, and then clamp the clamping strip with the lower edges of the third side plates on the two cross beams, so that the sofa fabric on the seat cushion can be fixed to the sofa seat frame. The process is simple and convenient, not only improves the installation efficiency, but also facilitates disassembly, has a high fault tolerance rate, and cannot cause material waste.

Further, the third side plate, the fourth side plate and the second supporting plate are integrally formed by bending, and are inverted U-shaped.

Therefore, the cross beam formed by integral bending has higher supporting strength and is convenient to process. In addition, each cross beam is arranged in an inverted U shape, so that the structure of the cross beam is stabler and the supporting strength is higher, thus improving the overall supporting strength of the sofa seat frame.

Further, the two ends of each cross beam are also provided with reinforcing plates, and the reinforcing plates are connected with the third side plates and the fourth side plates.

Therefore, by arranging the reinforcing plates at two ends of each cross beam, the structure of the cross beam is stabler and the supporting strength of the cross beam is further improved.

In addition, a second aspect of the invention also provides a sofa base assembly which comprises a rack and the sofa seat frame which is detachably connected with the rack and is provided by the first aspect of the invention, wherein:

the rack comprises two metal supporting legs arranged opposite to each other; and third supporting plates of the sofa seat frame are detachably connected to the supporting legs.

Therefore, by arranging the third supporting plates to be connected with the supporting legs, the supporting area at the joint between the sofa seat frame and the rack can be improved, thus improving the overall supporting strength of the rack to the sofa seat frame and making the sofa seat frame stabler and firmer. In addition, the supporting legs made of a metal material are adopted for replacing the existing wooden frame structure, not only have a simple structure, but also have higher supporting strength and improve the overall stability of the sofa base assembly.

Besides, a third aspect of the invention further provides a functional sofa base assembly which comprises a functional rack and the sofa seat frame which is detachably connected to the functional rack and is provided by the first aspect of the invention, wherein:

the functional rack comprises a first base and two telescopic brackets arranged on the first base at intervals, each telescopic bracket comprising a seat frame mounting plate and a first mounting plate arranged on the seat frame mounting plate; and the third supporting plates of the sofa seat frame are detachably connected to the first mounting plates.

Therefore, by arranging the third supporting plates to be connected with the first mounting plates, the supporting area of the joint between the sofa seat frame and the functional rack can be improved, thus improving the overall supporting strength of the functional rack to the sofa seat frame and making the sofa seat frame stabler and firmer.

Further, the first mounting plate is formed by bending the seat frame mounting plate.

Therefore, the supporting strength of the first mounting plate formed by bending the seat frame mounting plate is higher.

Further, the first mounting plate is arranged at a middle position in the height direction of the seat frame mounting plate.

Therefore, by arranging the first mounting plate at the middle position in the height direction of the seat frame mounting plate, the height of the first mounting piece is lowered, thereby lowering the mounting height of the sofa seat frame, and further improving the sitting comfort of users.

Further, third side plates of the cross beams close to a sofa backrest are provided with an extension plate used for being detachably connected with the sofa fabric on the seat cushion.

Therefore, the extension plate is arranged to be connected with the sofa fabric, so that a motor at the bottom of the sofa can be sealed to prevent articles or dust from falling into the motor to affect the motor at the bottom of the sofa.

Further, the extension plate is provided with a positioning hole.

Therefore, the positioning hole can be used for fixing a power plug of the motor at the bottom of the sofa.

In addition, a fourth aspect of the invention further provides a sofa, which comprises the sofa base assembly provided by the second aspect of the invention, a seat cushion and sofa fabric wrapping the seat cushion, sofa armrests, a sofa backrest and a sofa foot pad plate, wherein the sofa fabric, the sofa armrests and the sofa backrest are all detachably connected with the sofa seat frame, and the sofa foot pad plate is detachably connected with the supporting legs.

Further, the edge of the sofa fabric is provided with a clamping strip, and the sofa fabric is clamped with the lower edges of the first side plates of the two longitudinal beams through the clamping strip.

Further, the sofa also comprises fourth connecting pieces, wherein each fourth connecting piece comprises a first member connected to the first side plate of the longitudinal beam and a second member connected to the sofa armrest, and the first member and the second member are in sliding insertion fit;

or, the first member is connected to the sofa armrest, the second member is connected to the first side plate of the longitudinal beam, and the first member and the second member are in sliding insertion fit.

Further, the first member comprises a first substrate, two guide rails arranged at intervals on the first substrate, and a stopper arranged on the first substrate and located under the two guide rails; the second member comprises a second substrate and two guide bars arranged at intervals on the second substrate, and the two guide bars are respectively in sliding insertion fit with the two guide rails.

In addition, a fifth aspect of the invention further provides a functional sofa which comprises the functional sofa base assembly provided by the third aspect of the invention, the seat cushion and the sofa fabric wrapping the seat cushion, the sofa armrests, the sofa backrest and the sofa foot pad plate, wherein the sofa fabric and the sofa armrests are detachably connected with the sofa seat frame; and the sofa backrest and the sofa foot pad plate are detachably connected with the telescopic brackets.

Further, the edge of the sofa fabric is provided with a clamping strip, and the sofa fabric is clamped with the lower edges of the first side plates of the two longitudinal beams through the clamping strip.

Further, the functional sofa also comprises fourth connecting pieces, wherein each fourth connecting piece comprises a first member connected to the first side plate of the longitudinal beam and a second member connected to the sofa armrest, and the first member and the second member are in sliding insertion fit;

or, the first member is connected to the sofa armrest, the second member is connected to the first side plate of the longitudinal beam, and the first member and the second member are in sliding insertion fit.

Further, the first member comprises a first substrate, two guide rails arranged at intervals on the first substrate, and a stopper arranged on the first substrate and located under the two guide rails; the second member comprises a second substrate and two guide bars arranged at intervals on the second substrate, and the two guide bars are respectively in sliding insertion fit with the two guide rails.

In addition, a sixth aspect of the invention also provides a sofa production and assembly process, comprising the following steps:

producing cross beams and longitudinal beams according to defined dimensions, and assembling the two cross beams and the two longitudinal beams to form a sofa seat frame;

installing a plurality of serpentine springs between the two cross beams of the sofa seat frame to form a seat cushion supporting structure;

producing a plurality of first connecting pieces according to defined dimensions, wherein each of the first connecting pieces comprises two symmetrically arranged fifth side plates and a third supporting plate connecting the bottoms of the two fifth side plates, the two fifth side plates of each of plurality of the first connecting pieces are connected with the longitudinal beams to realize the connection of the plurality of first connecting pieces with the sofa seat frame;

producing two supporting legs according to defined dimensions to obtain a rack;

connecting the third supporting plates of the first connecting pieces with the supporting legs to realize the connection of the sofa seat frame with the rack to obtain a sofa base assembly; and completing the production and assembly of the sofa according to the obtained sofa base assembly.

Therefore, the sofa production and assembly process provided by the invention breaks the traditional concept of sofa production and assembly, the sofa seat frame, the rack, the seat cushion, the sofa armrests, the sofa backrest and the sofa foot pad plate all adopt modular design, and the assembly connection between them is realized through a simple connection structure, thus greatly improving the production and assembly efficiency of the sofa, reducing the labor cost, and being suitable for large-scale assembly line industrial production.

Further, the step of "completing the production and assembly of the sofa according to the obtained sofa base assembly" further comprises the following steps:

placing a seat cushion on the seat cushion supporting structure;

processing the sofa fabric to set dimensions, and fixing a clamping strip on the edge of the sofa fabric, then wrapping the seat cushion with the sofa fabric, and fixing the sofa fabric to the sofa seat frame via the clamping strip on the sofa fabric, thus completing the production and assembly of the seat cushion; and installing sofa armrests and a sofa backrest on the sofa seat frame, and installing a sofa foot pad plate on the supporting legs, thus completing the production and assembly of the sofa.

In addition, a seventh aspect of the invention also provides a functional sofa production and assembly process, comprising the following steps:

producing cross beams and longitudinal beams according to defined dimensions, and assembling the two cross beams and the two longitudinal beams to form a sofa seat frame;

installing a plurality of serpentine springs between the two cross beams of the sofa seat frame to form a seat cushion supporting structure;

producing a plurality of first connecting pieces according to defined dimensions, wherein each of the first connecting pieces comprises two symmetrically arranged fifth side plates and a third supporting plate connecting the bottoms of the two fifth side plates, the two fifth side plates of each of the plurality of first connecting pieces are connected with the longitudinal beams to realize the connection of the plurality of first connecting pieces with the sofa seat frame;

producing parts of a functional rack according to defined dimensions and assembling the parts to obtain the functional rack; wherein the functional rack comprises two telescopic brackets arranged symmetrically, and each telescopic bracket comprises a seat frame mounting plate and a first mounting plate arranged on the seat frame mounting plate;

connecting the third supporting plates of the first connecting pieces with the first mounting plates of the telescopic brackets to realize the connection of the sofa seat frame with the functional rack to obtain a functional sofa base assembly; and completing the production and assembly of the functional sofa according to the obtained functional sofa base assembly.

Therefore, the functional sofa production and assembly process provided by the invention breaks the traditional concept of functional sofa production and assembly, the sofa seat frame, the functional rack, the seat cushion, the sofa armrests, the sofa backrest and the sofa foot pad plate all adopt modular design, and the assembly connection among them is realized through a simple connection structure, thus greatly improving the production and assembly efficiency of the functional sofa, reducing the labor cost, and being suitable for large-scale assembly line industrial production.

Further, the step of "completing the production and assembly of the functional sofa according to the obtained functional sofa base assembly" further comprises the following steps:

placing a seat cushion on the seat cushion supporting structure;

processing the sofa fabric to set dimensions, and fixing a clamping strip on the edge of the sofa fabric, then wrapping the seat cushion with the sofa fabric, and fixing the sofa fabric to the sofa seat frame via the clamping strip on the sofa fabric, thus completing the production and assembly of the seat cushion; and installing a sofa backrest and a sofa foot pad plate on the telescopic brackets, and installing sofa armrests on the sofa seat frame, thus completing the production and assembly of the functional sofa.

To sum up, the sofa seat frame, the sofa base assembly, the sofa and the sofa production and assembly process provided by the invention have the following technical effects:

1) According to the sofa seat frame provided by the invention, the supporting structure for supporting the seat cushion can be formed by arranging the plurality of supporting elastic pieces between the two cross beams. As the longitudinal beams are provided with the first supporting plates, when the seat cushion is placed on the supporting structure, the first supporting plates can also give a certain supporting force to the seat cushion, thus improving the sitting comfort of users. In addition, when the sofa fabric is assembled, it is only necessary to install the clamping strip at the edge of the sofa fabric, and then clamp the clamping strip with the lower edges of the first side plates of the two longitudinal beams to fix the sofa fabric on the seat cushion to the sofa seat frame. The process is simple and convenient, not only improves the installation efficiency, but also facilitates disassembly, has a high fault tolerance rate and cannot cause material waste.

2) According to the sofa seat frame provided by the invention, the arranged second side plates not only make the overall structure of the longitudinal beams stabler, but also improve the firmness of connection with the cross beams and the bottom rack, thus improving the overall stability of the sofa seat frame and increasing the supporting strength of the sofa seat frame.

3) According to the sofa seat frame provided by the invention, the installation efficiency between the sofa seat frame and the sofa rack can be improved by arranging the plurality of first connecting pieces on the sofa seat frame. In addition, since the first connecting pieces are provided with the third supporting plates, the supporting area of the joint between the sofa seat frame and the sofa rack is increased, the overall supporting strength of the sofa rack to the sofa seat frame is further improved, and the sofa seat frame is stabler and firmer.

4) According to the sofa seat frame provided by the invention, the hooks integrally formed on each cross beam by the stamping process have higher strength than the existing hooks welded or connected to a cross beam by other forms, and are less likely to be damaged under the pulling action of the supporting elastic pieces, thus prolonging the service life of the sofa seat frame, simplifying the assembly process, and omitting the step of welding the hooks.

5) According to the sofa seat frame provided by the invention, the arrangement of the protrusion on each hook can not only prevent the supporting elastic piece from being separated from the hook during use, but also avoid bending the end of the supporting elastic piece to reinforce the connection with the hook when the supporting elastic piece is hooked, thus reducing the assembly steps and improving the assembly efficiency.

6) According to the sofa base assembly provided by the invention, the third supporting plates are arranged to be connected with the supporting legs, so that the supporting area of the joint between the sofa seat frame and the supporting legs can be improved, thereby improving the supporting strength of the rack to the sofa seat frame and making the sofa seat frame stabler and firmer. In addition, the supporting legs made of a metal material are adopted for replacing the existing wooden frame structure, so that the structure is simple, and the supporting strength is higher, and the overall stability of the sofa base is improved.

7) According to the functional sofa base assembly provided by the invention, the third supporting plates are arranged to be connected with the first mounting plates, so that the supporting area of the joint between the sofa seat frame and the functional rack is improved, thereby improving the overall supporting strength of the functional rack to the sofa seat frame and making the sofa seat frame stabler and firmer.

8) According to the sofa production and assembly process provided by the invention, the traditional concept of sofa production and assembly is broken, the sofa seat frame, the rack, the seat cushion, the sofa armrests, the sofa backrest and the sofa foot pad plate all adopt modular design, and the assembly connection among them is realized through a simple connection structure, so that the sofa production and assembly efficiency is greatly improved, the labor cost is reduced, and the sofa production and assembly process provided by the invention is suitable for large-scale assembly line industrial production.

9) The functional sofa production and assembly process provided by the invention breaks the traditional concept of sofa production and assembly, the sofa seat frame, the functional rack, the seat cushion, the sofa armrests, the sofa backrest and the sofa foot pad plate all adopt modular design, and the assembly connection among them is realized through a simple connection structure, thus greatly improving the production and assembly efficiency of the functional sofa and reducing the labor cost, and the functional sofa production and assembly process provided by the invention is suitable for large-scale assembly line industrial production.

Figure 1:
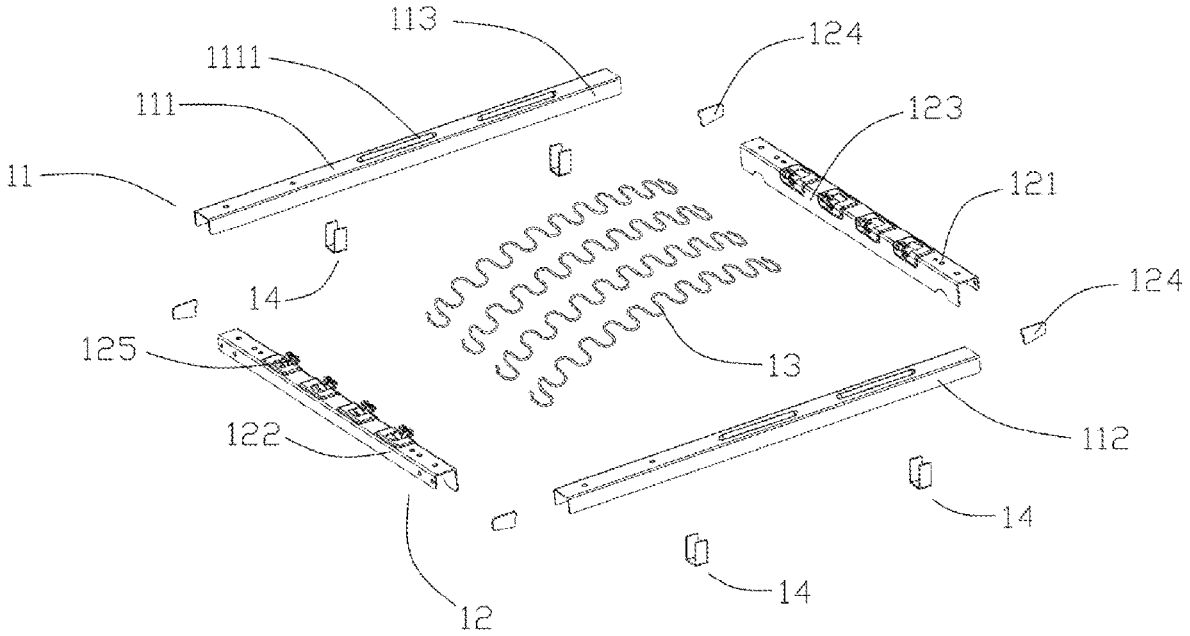
FIG. 1 is an explosion schematic view of a sofa seat frame according to Embodiment 1 of the present invention.

Wherein, the description of Reference Numerals is as follows:

1. Sofa seat frame; 11. Longitudinal beam; 111. First supporting plate; 1111, Reinforcing rib; 112. First side plate; 113. Second side plate; 12. Cross beam; 121. Second supporting plate; 122. Third side plate; 123. Fourth side plate; 124. Reinforcing plate; 125. Hook; 1251. Protrusion; 13. Supporting elastic piece; 14. First connecting piece; 141. Third supporting plate; 142. Fifth side plate; 2. Extension plate; 21. Positioning hole; 3. Rack; 31. Supporting leg; 4. Functional rack; 41. First base; 411. First underframe; 42. Linkage mechanism; 421. First linkage lever; 4211. Rotating square tube; 42111. First connecting bracket; 4212. Rotating angle iron; 422. Second linkage lever; 423. First driving bracket; 424. Second driving bracket; 43. Telescopic bracket; 431. Backrest mechanism; 4311. First back bar; 4312. Second mounting plate; 432. Seat plate linkage mechanism; 4321. Seat frame mounting plate; 43211. First mounting plate; 4322. First supporting piece; 4323. Second supporting piece; 4324. First seat frame bracket; 433. Leg extension mechanism; 4331. First foot bar; 4332. Second foot bar; 4333. Third foot bar; 4334. Fourth foot bar; 4335. Fifth foot bar; 4336. Third mounting plate; 5. Sofa armrest; 6. Sofa backrest; 7. Sofa foot pad plate; 81. Second connecting piece; 811. Fourth supporting plate; 812. Sixth side plate; 82. Third connecting piece; 821. Fifth supporting plate; 822. Seventh side plate; 83. Fourth connecting piece; 831. First member; 8311. First substrate; 8312. Guide rail; 8313. Stopper; 8314. Bolt hole; 832. Second member; 8321. Second substrate; 8322. Guide bar; 9. Second base; and 91. Second underframe.

DETAILED DESCRIPTION OF THE ILLUSTRATED EMBODIMENTS

For better understanding and implementation, the technical solutions in the embodiments of the present invention will be clearly and completely described in conjunction with the accompanying drawings in the embodiments of the present invention.

Unless otherwise defined, all technical and scientific terms used herein have the same meanings as generally understood by those skilled in the art of the present invention. Terms used herein in the description of the invention are for the purpose of describing specific embodiments only and are not intended to limit the invention.

Embodiment 1

Referring to FIGS. 1-5, the invention discloses a sofa seat frame 1 which comprises two cross beams 12 arranged at intervals and two longitudinal beams 11 connecting the two cross beams 12, and a plurality of supporting elastic pieces 13 are arranged between the two cross beams 12. In the embodiment, the two cross beams 12 and the two longitudinal beams 11 are both symmetrically arranged and the ends of the two cross beams 12 and the ends of the two longitudinal beams 11 are connected mutually to form a rectangular frame structure; and the two cross beams 12 and the two longitudinal beams 11 can be fixed by screwing or welding.

In the embodiment, the cross beam 12 and the longitudinal beam 11 are both metal pieces, of course, in other embodiments, the cross beam 12 and the longitudinal beam 11 can also be made by injection molding of engineering plastic or by combining metal with the engineering plastic.

Referring to FIG. 1, each longitudinal beam 11 comprises a first side plate 112, a second side plate 113 arranged at a distance from the first side plate 112, and a first supporting plate 111 connecting the top of the first side plate 112 with the top of the second side plate 113. The first supporting plate 111 is used for supporting a seat cushion, and the first side plate 112 is used for being detachably connected with sofa fabric on the seat cushion. In this embodiment, the longitudinal beam 11 is in an inverted U shape, and the first supporting plate 111 is in a strip-shaped flat plate shape and is parallel to the horizontal plane; and the first side plate 112 and the second side plate 113 are both connected to the first supporting plate 111 in an L shape. Preferably, the upper surface of the first supporting plate 111 is flush with the upper surface of the cross beam 12 so as to better support the seat cushion. The first side plate 112 and the second side plate 113 are two vertical plates having the same height, and are respectively arranged on two sides of the lower end of the first supporting plate 111. The first side plate 112 is located on the outer side of the rectangular frame structure so as to facilitate connection with the sofa fabric on the seat cushion; and the second side plate 113 is located on the inner side of the rectangular frame structure.

Preferably, the first side plate 112, the second side plate 113 and the first supporting plate 111 are integrally formed by bending. The first side plate 112, the second side plate 113 and the first supporting plate 111 are formed by bending the same steel plate in order to facilitate processing and maintain the relatively high supporting strength of the longitudinal beam 11. It should be noted that the first side plate 112, the second side plate 113 and the first supporting plate 111 are not limited to the integrally formed structure, and can also be fixed by welding.

Therefore, each longitudinal beam 11 is provided with the first supporting plate 111, and when the seat cushion is placed on the plurality of supporting elastic pieces 13, the first supporting plates 111 can also give a certain supporting force to the seat cushion, thus improving the sitting comfort of users. Secondly, when the sofa fabric is assembled, it is only necessary to install a clamping strip at the edge of the sofa fabric, and then clamp the clamping strip on the sofa fabric with the lower edges of the first side plates 112 of the two longitudinal beams 11, so that the sofa fabric on the seat cushion can be fixed to the sofa seat frame 1. The process is simple and convenient, not only improves the installation efficiency, but also facilitates disassembly, has a high fault tolerance rate, and cannot cause material waste. In addition, by arranging the second side plates 113, not only is the overall structure of the longitudinal beams 11 stabler, but also the firmness of its connection with the cross beams 12 and the bottom rack is improved, thus improving the overall stability of the sofa seat frame 1 and increasing its supporting strength. In addition, each longitudinal beam 11 is arranged in an inverted U shape, so that the structure of the longitudinal beam 11 is stabler and the supporting strength is higher, thus improving the overall supporting strength of the sofa seat frame 1.

In addition, each first supporting plate 111 is further provided with a plurality of reinforcing ribs 1111, so that the strength of the longitudinal beam 11 is enhanced and the structure of the longitudinal beam 11 is stabler.

Referring again to FIG. 1, each cross beam 12 comprises a third side plate 122, a fourth side plate 123 arranged at a distance from the third side plate 122, and a second supporting plate 121 connecting the top of the third side plate 122 with the top of the fourth side plate 123. The third side plate 122 is used for being detachably connected with the sofa fabric on the seat cushion, and the fourth side plate 123 is used for being connected with two ends of the longitudinal beam 11. In the present embodiment, the cross beam 12 is in an inverted U shape, and the second supporting plate 121 is also in a strip-shaped flat plate shape and is parallel to the horizontal plane; the third side plate 122 and the fourth side plate 123 are both connected to the second supporting plate 121 in an L shape. Preferably, the upper surface of the second supporting plate 121 is flush with the upper surface of the first supporting plate 111 of the longitudinal beam 11. The third side plate 122 and the fourth side plate 123 are two vertical plates having different heights. The height of the fourth side plate 123 is higher than that of the third side plate 123, and the third side plate 122 and the fourth side plate 123 are respectively arranged on two sides of the lower part of the second supporting plate 121. The third side plate 122 is located on the outer side of the rectangular frame structure, and the fourth side plate 123 is located on the inner side of the rectangular frame structure.

Preferably, the third side plate 122, the fourth side plate 123 and the second supporting plate 121 are integrally formed by bending. The third side plate 122, the fourth side plate 123 and the second supporting plate 121 are formed by bending the same steel plate in order to facilitate processing and maintain the relatively high supporting strength of the cross beam 12. It should be noted that the third side plate 122, the fourth side plate 123 and the second supporting plate 121 are not limited to the integrally formed structure, and can also be fixed by welding. Further, reinforcing plates 124 are arranged at two ends of each cross beam 12, and the reinforcing plates 124 are connected to the third side plate 122 and the fourth side plate 123.

Therefore, when the sofa fabric is assembled, it is only necessary to install the clamping strip at the edge of the sofa fabric, and then clamp the clamping strip on the sofa fabric with the lower edges of the third side plates 122 of the two cross beams 12, so that the sofa fabric on the seat cushion can be fixed to the sofa seat frame 1. The process is simple and convenient, not only improves the installation efficiency, but also facilitates disassembly, has a high fault tolerance rate, and cannot cause material waste. In addition, each cross beam 12 is arranged in an inverted U shape, and the reinforcing plates 124 are arranged at the two ends of the cross beam 12, so that the structure of the cross beam 12 is stabler and the supporting strength is higher.

In addition, since the two ends of the longitudinal beams 11 are connected to the fourth side plates 123 of the two cross beams 12 respectively, the structure of the sofa seat frame 1 thus formed is stabler and the supporting strength is higher. Admittedly, in other preferred embodiments, it is also possible to connect the two ends of the cross beams 12 to the second side plates 113 of the two longitudinal beams 11, and to arrange the reinforcing plates 124 at the two ends of each longitudinal beam 11.

Referring to FIGS. 1-5, each cross beam 12 is provided with a plurality of hooks 125 for connecting the supporting elastic pieces 13. The plurality of hooks 125 are integrally formed on each of the two cross beams 12 by a stamping process and are uniformly arranged in the axial direction of the cross beam 12, and the hooks 125 on the two cross beams 12 are symmetrically arranged. In the present embodiment, the plurality of hooks 125 are formed by stamping the second supporting plate 121 and the fourth side plate 123.

Therefore, the hooks 125 formed by stamping have higher strength than the existing hooks 125 connected to the cross beam 12 by welding or other forms, and are less likely to be damaged under the elastic force of the supporting elastic pieces 13, thereby prolonging the service life of the whole sofa, simplifying the assembly process and omitting the step of welding the hooks 125.

Specifically, each hook 125 is substantially C-shaped. Each hook 125 is also provided with a protrusion 1251 for preventing the unhooking of the supporting elastic piece 13. The protrusion 1251 not only prevents the supporting elastic piece 13 from being separated from the hook 125 during use, but also avoids bending the end of the supporting elastic piece 13 to reinforce the connection with the hook 125 when the supporting elastic piece 13 is hooked, thereby reducing the assembly steps and improving the assembly efficiency.

In the present embodiment, each supporting elastic piece 13 is a serpentine spring. The two ends of the serpentine spring are respectively movably hooked on the hooks 125 of the two cross beams 12. As such, a plurality of serpentine springs are arched upward toward the sitting face of the sofa seat frame 1, thereby forming an arc-shaped sitting surface, which has good vibration damping performance and improves the sitting comfort of users. Admittedly, in other preferred embodiments, the supporting elastic piece 13 can also be a rubber band or a combination of a serpentine spring and the rubber band to achieve the effect of elastically supporting the seat cushion of the sofa.

Figure 2:
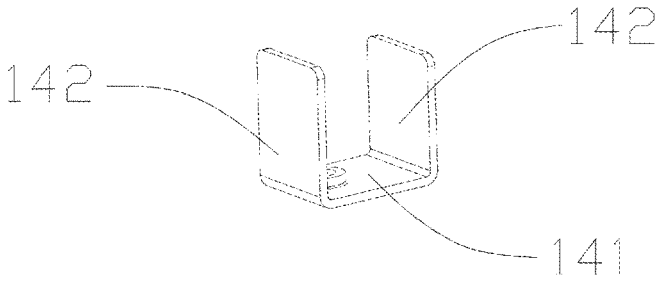
FIG. 2 is a structural schematic diagram of a first connecting piece in a sofa seat frame according to Embodiment 1 of the present invention.

Referring to FIGS. 1-2, the sofa seat frame 1 further comprises a plurality of first connecting pieces 14, and in this embodiment, four first connecting pieces 14 are symmetrically arranged on the longitudinal beams 11 in pairs. Each first connecting piece 14 comprises two fifth side plates 142 arranged at intervals and a third supporting plate 141 connecting the bottoms of the two fifth side plates 142. Specifically, the first connecting piece 14 is in a U shape, and the third supporting plate 141 is in a flat plate shape and is parallel to the horizontal plane; the two fifth side plates 142 are connected to the third supporting plate 141 in an L shape, and the two fifth side plates 142 are symmetrically arranged on two sides of the upper part of the third supporting plate 141.

Preferably, the two fifth side plates 142 and the third supporting plate 141 are integrally formed by bending. In order to facilitate processing and maintain the relatively high supporting strength of the first connecting piece 14, the two fifth side plates 142 and the third supporting plate 141 are formed by bending the same steel plate. It should be noted that the two fifth side plates 142 and the third supporting plate 141 are not limited to the integrally formed structure, and can also be fixed by welding.

Figure 3:
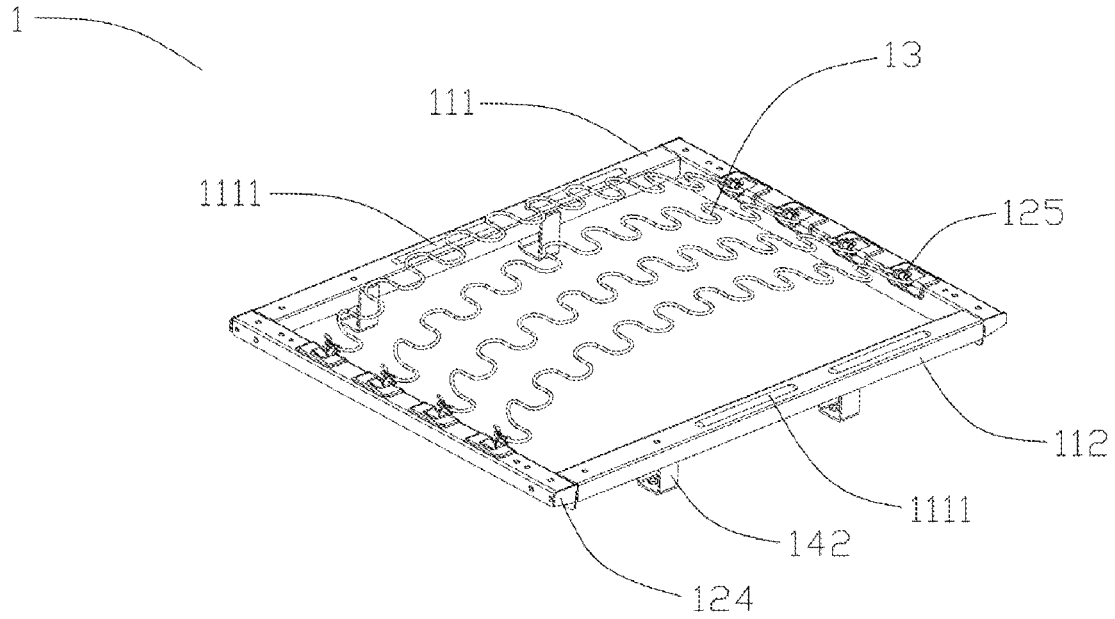
FIG. 3 is a structural schematic diagram of a sofa seat frame according to Embodiment 1 of the present invention.
Figure 4:
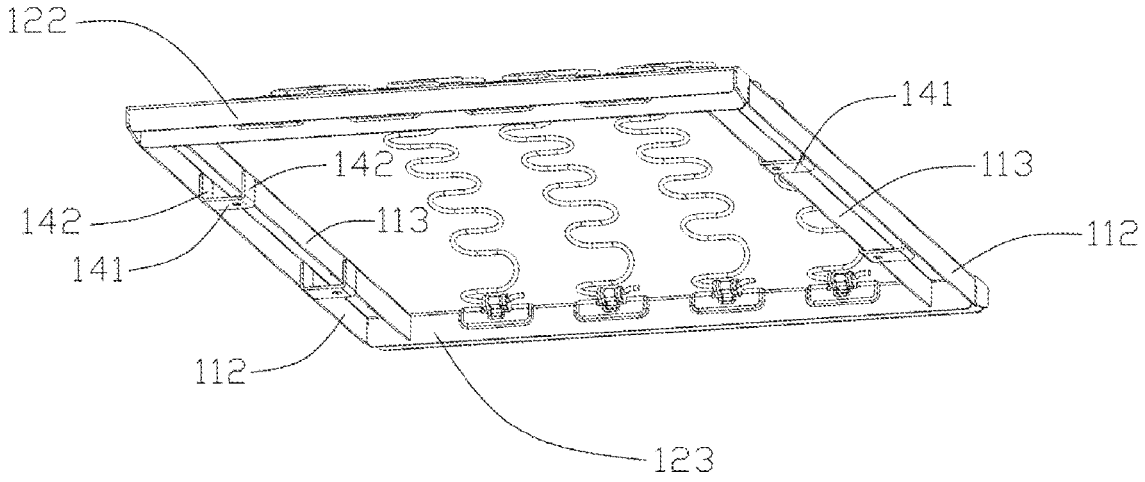
FIG. 4 is a schematic structural diagram of a sofa seat frame from another viewing angle according to Embodiment 1 of the present invention.
Figure 5:
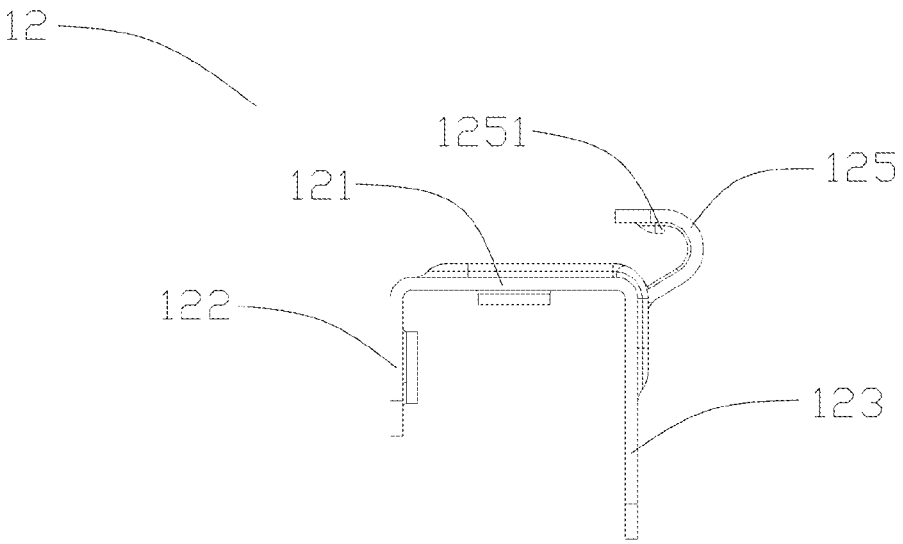
FIG. 5 is a side view of a cross beam in a sofa seat frame according to Embodiment 1 of the present invention.

Referring to FIGS. 3-4, specifically, one fifth side plate 142 of each first connecting piece 14 is connected to the side face of the first side plate 112 of the longitudinal beam 11 close to the second side plate 113, the other fifth side plate 142 is connected to the side face of the second side plate 113 of the longitudinal beam 11 away from the first side plate 112, and the third supporting plate 141 is detachably connected to the sofa rack.

In this embodiment, the two fifth side plates 142 are fixed to the first side plate 112 and the second side plate 113 by welding, respectively, and the third supporting plate 141 is fixed to the sofa rack by bolted connection.

As a result, each first connecting piece 14 is arranged in a U shape, so that the structure of the first connecting piece 14 is stabler and the supporting strength is higher. By arranging the third supporting plates 141 to be connected with the sofa rack, the supporting area at the joint of the sofa seat frame 1 and the sofa rack can be increased, thereby improving the overall supporting strength of the sofa rack to the sofa seat frame 1 and making the sofa seat frame 1 stabler and firmer.

Embodiment 2

Figure 6:
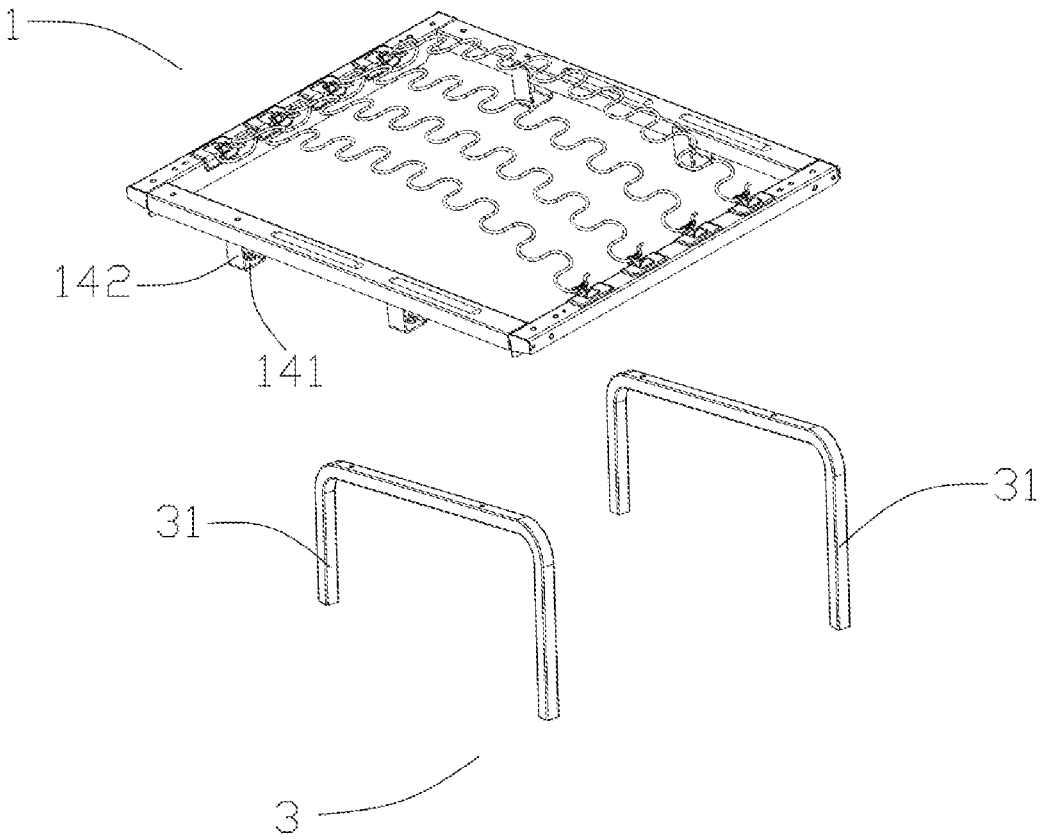
FIG. 6 is an explosion schematic view of a sofa base assembly according to Embodiment 2 of the present invention.
Figure 7:
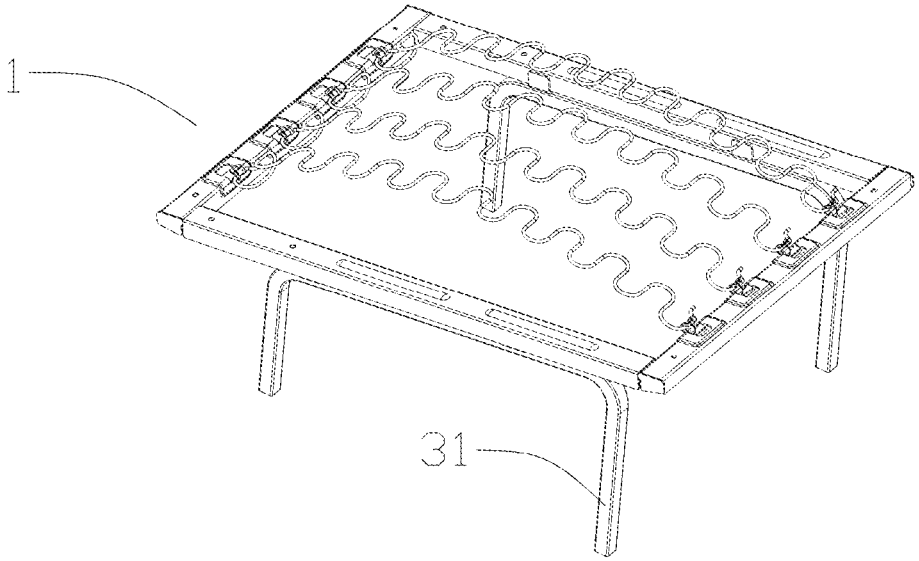
FIG. 7 is a structural schematic diagram of a sofa base assembly of Embodiment 2 of the present invention.

Referring to FIGS. 6-7, the invention also provides a sofa base assembly comprising the sofa seat frame 1 in Embodiment 1 and a rack 3, and the rack 3 comprises two oppositely arranged supporting legs 31. In the present embodiment, each supporting leg 31 is substantially inverted U-shaped and is made of a metal material. Therefore, the supporting legs 31 made of a metal material are adopted for replacing the existing wooden frame structure, not only have a simple structure, but also have higher supporting strength and improve the overall stability of the sofa base.

Referring to FIGS. 6-7, the third supporting plates 141 on the sofa seat frame 1 are detachably connected to the top surfaces of the supporting legs 31. In the present embodiment, the third supporting plates 141 and the supporting legs 31 are fixed by means of bolts or screws.

Therefore, by arranging the third supporting plates 141 to be connected with the supporting legs 31, the supporting area at the joints between the sofa seat frame 1 and the supporting legs 31 can be increased, the supporting strength of the rack 3 to the sofa seat frame 1 can be improved, and the sofa seat frame 1 can be stabler and firmer.

Embodiment 3

Figure 8:
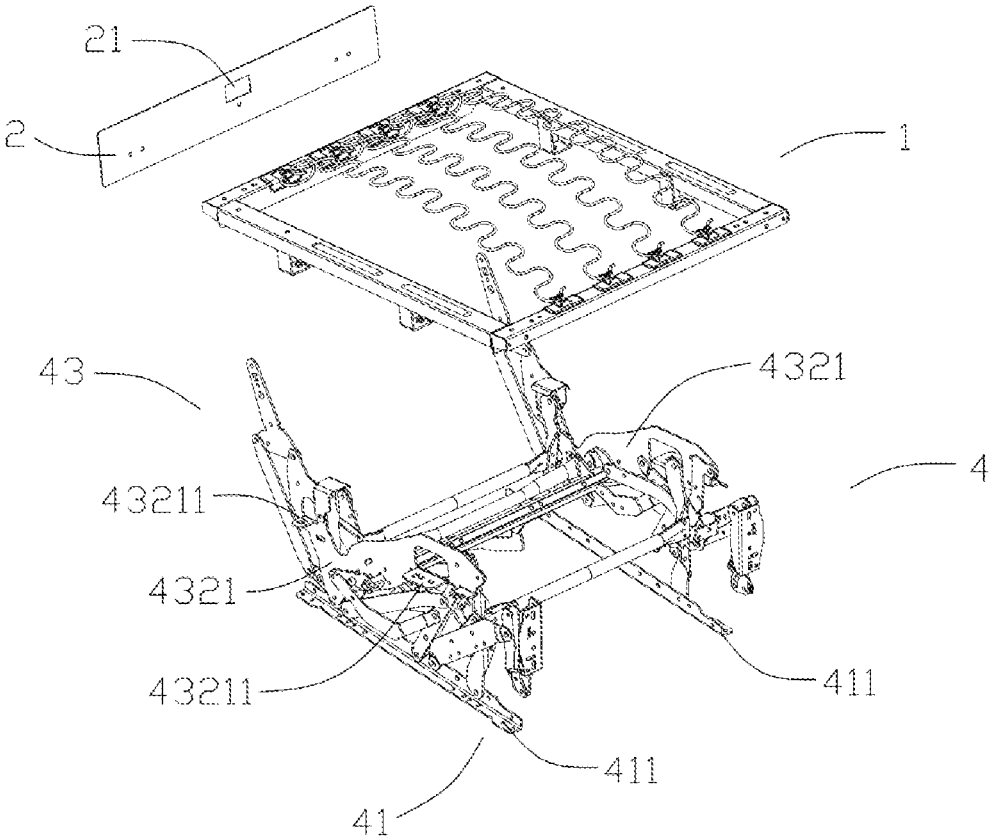
FIG. 8 is an explosion schematic diagram of a functional sofa base assembly according to Embodiment 3 of the present invention.

Referring to FIG. 8, the invention also provides a functional sofa base assembly, which comprises the sofa seat frame 1 in Embodiment 1 and a functional rack 4. The functional rack 4 comprises a first base 41 and two telescopic brackets 43 symmetrically arranged on the first base 41, and the first base 41 and the telescopic brackets 43 are both made of a metal material. The first base 41 is formed by two strip-shaped first underframes 411 arranged in parallel, and each telescopic bracket 43 comprises a seat frame mounting plate 4321 and first mounting plates 43211 fixed to the seat frame mounting plate 4321 and perpendicular to the seat frame mounting plate 4321, and the first mounting plate 43211 is parallel to the horizontal plane. In the present embodiment, there are four first mounting plates 43211, and the first mounting plates 43211 are symmetrically arranged on the seat frame mounting plates 4321 of the two telescopic brackets 43 in pairs.

Preferably, in order to ensure that the first mounting plate 43211 has greater supporting strength, the first mounting plate 43211 is formed by bending the seat frame mounting plate 4321, and an opening is formed between the first mounting plate 43211 and the seat frame mounting plate 4321. It should be noted that the first mounting plate 43211 and the seat frame mounting plate 4321 are not limited to the integrally bending formed structure, and can also be fixed by welding.

Figure 12:
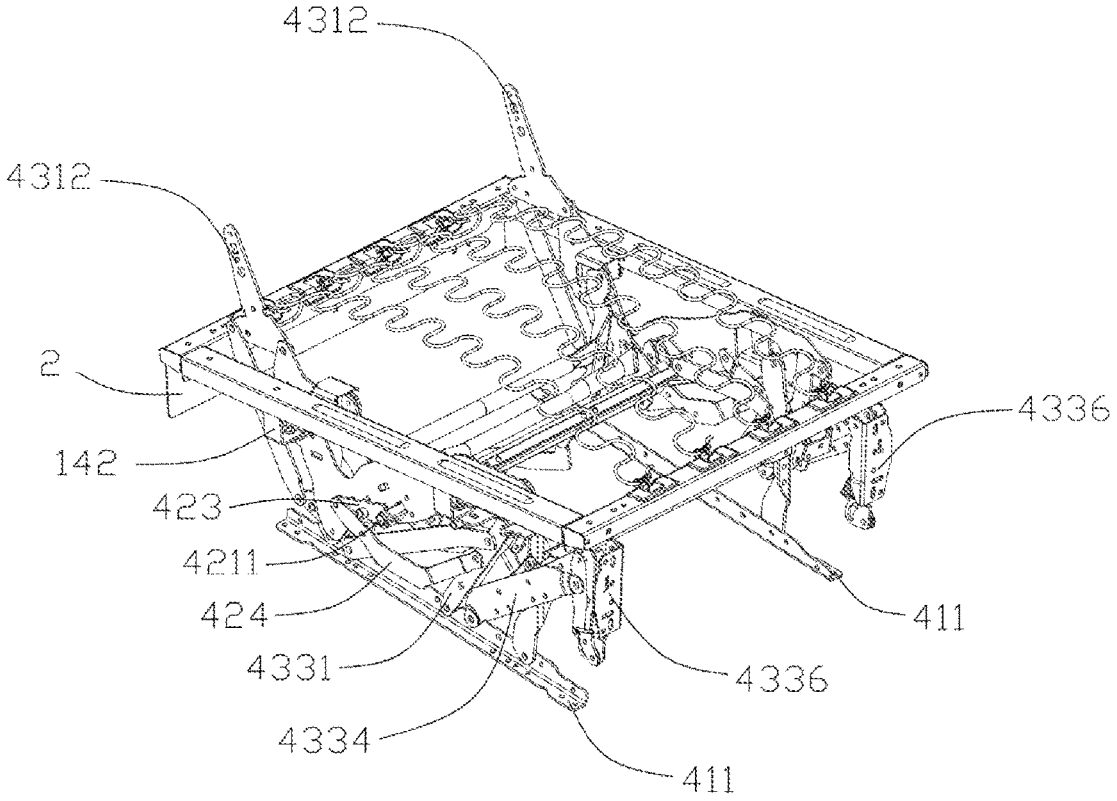
FIG. 12 is a structural schematic diagram of the functional sofa base assembly in a state of sitting posture according to Embodiment 3 of the present invention.
Figure 13:
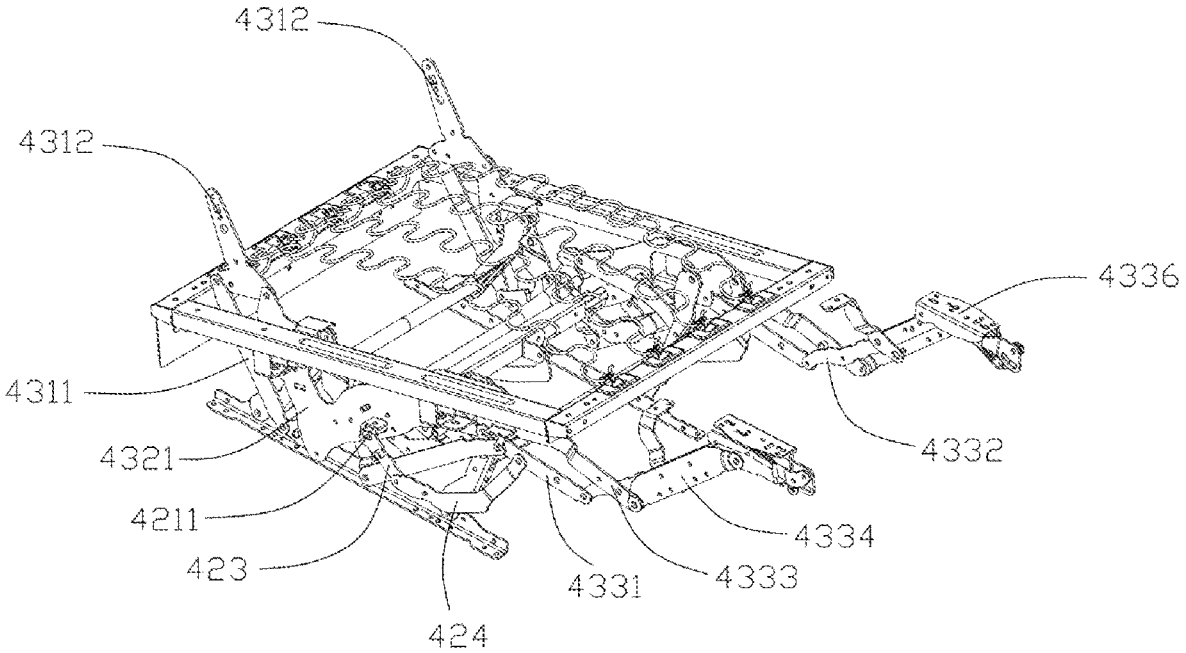
FIG. 13 is a structural schematic diagram of the functional sofa base assembly in a state of leisure posture according to Embodiment 3 of the present invention.
Figure 14:
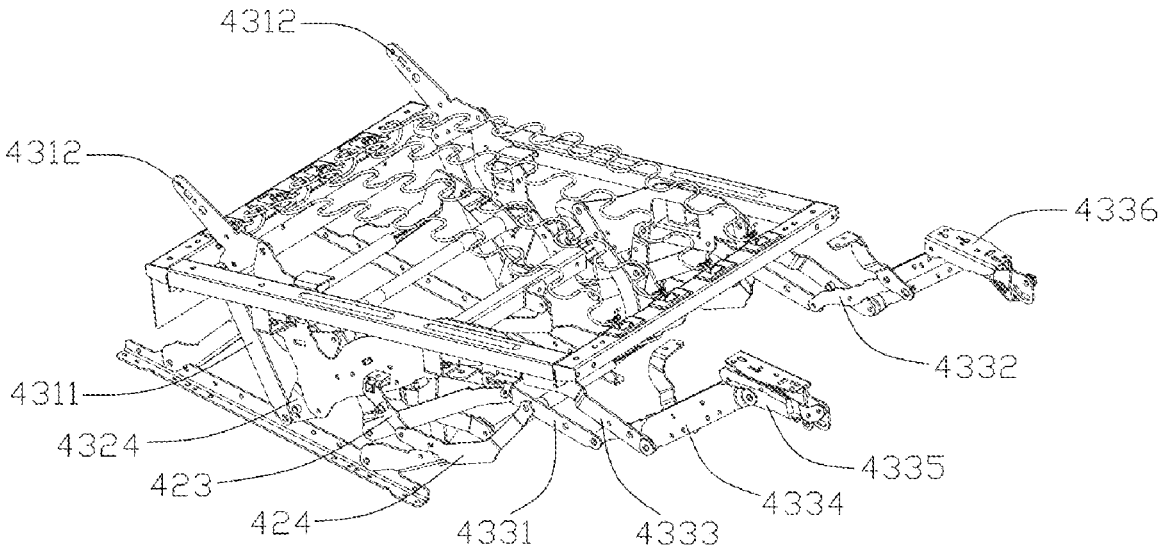
FIG. 14 is a structural schematic diagram of the functional sofa base assembly in a state of lying posture according to Embodiment 3 of the present invention.
Figure 15:
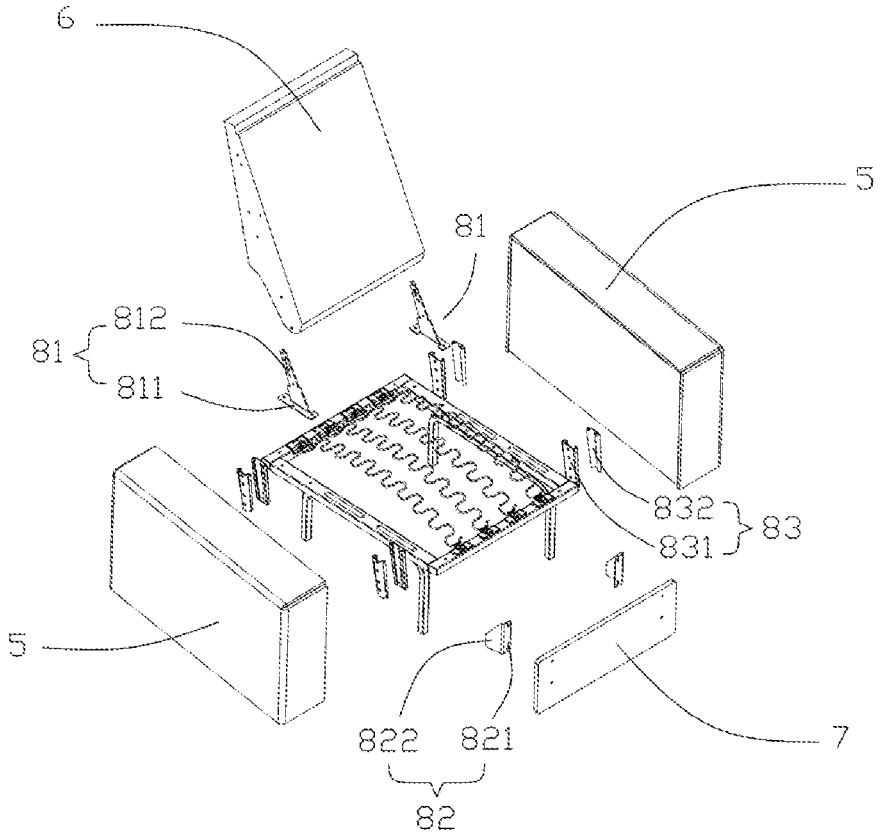
FIG. 15 is an explosion schematic view of a sofa according to Embodiment 4 of the present invention.

Referring to FIGS. 12-14, the third supporting plates 141 on the sofa seat frame 1 are connected to the first mounting plates 43211 of the telescopic brackets 43, thereby realizing the detachable connection of the sofa seat frame 1 to the functional rack 4. In the present embodiment, the third supporting plates 141 and the first mounting plates 43211 are connected and fixed by means of bolts or screws.

Therefore, the third supporting plates 141 are connected to the first mounting plates 43211, so that the supporting strength of the functional rack 4 to the sofa seat frame 1 is improved, and the sofa seat frame 1 is stabler and firmer.

In addition, the first mounting plate 43211 is arranged at a middle position in the height direction of the seat frame mounting plate 4321. As a result, by arranging the first mounting plate 43211 at the middle position in the height direction of the seat frame mounting plate 4321, the height of the first mounting plate 43211 is lowered, so that the mounting height of the sofa seat frame is lowered, and the sitting comfort of the user is further improved.

Further, the third side plates 122 of the cross beams 12 close to a sofa backrest 6 are provided with an extension plate 2 for detachable connection with the sofa fabric on the seat cushion. The extension plate 2 is provided with a positioning hole 21 for fixing a power plug of a motor at the bottom of the functional sofa.

Therefore, by connecting the extension plate 2 to the sofa fabric on the seat cushion, the motor at the bottom of the sofa can be sealed to prevent articles or dust from falling into the motor to affect the motor at the bottom of the sofa.

Figure 9:
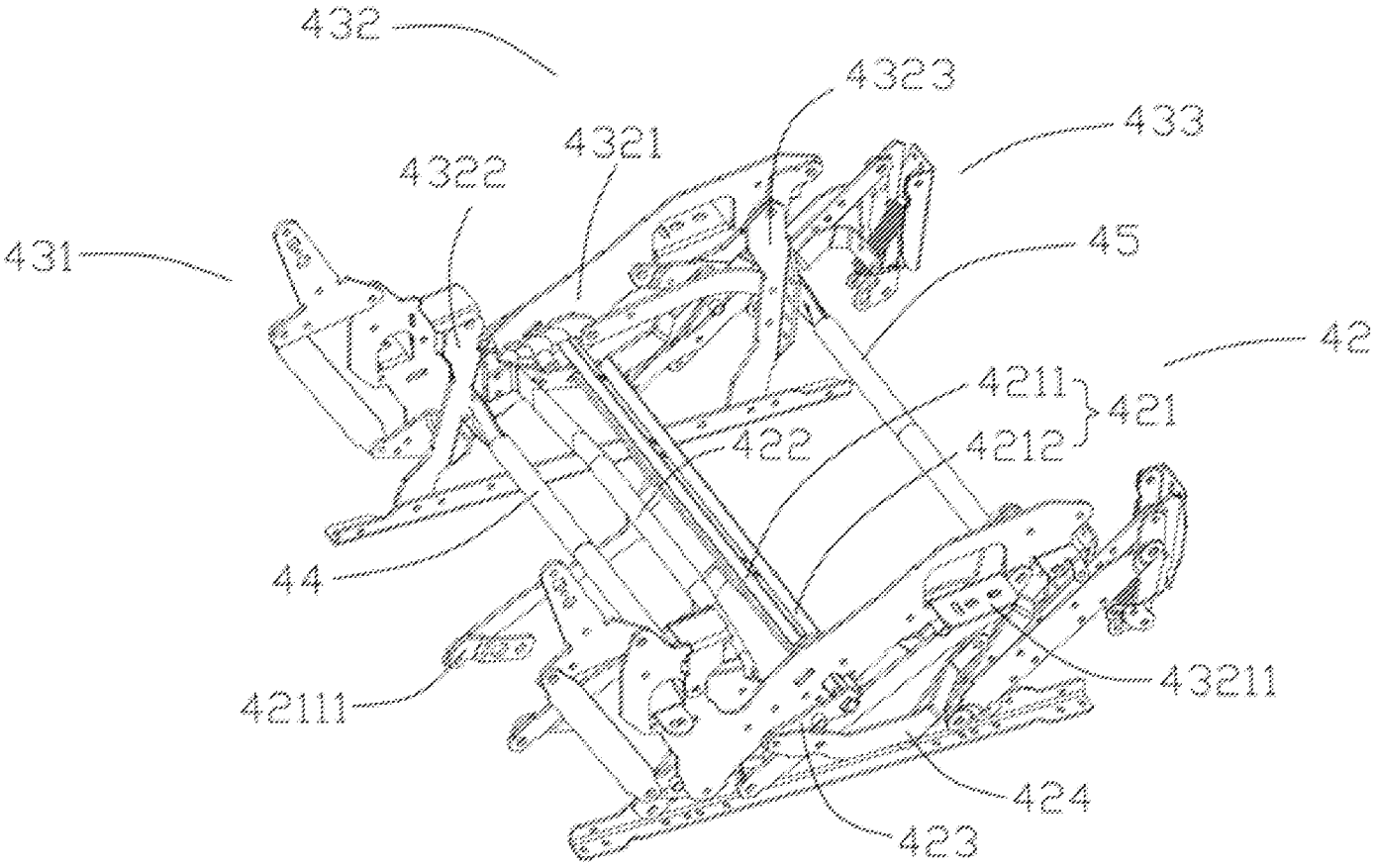
FIG. 9 is a schematic structural diagram of a functional rack in FIG. 8 in a state of sitting posture.
Figure 10:
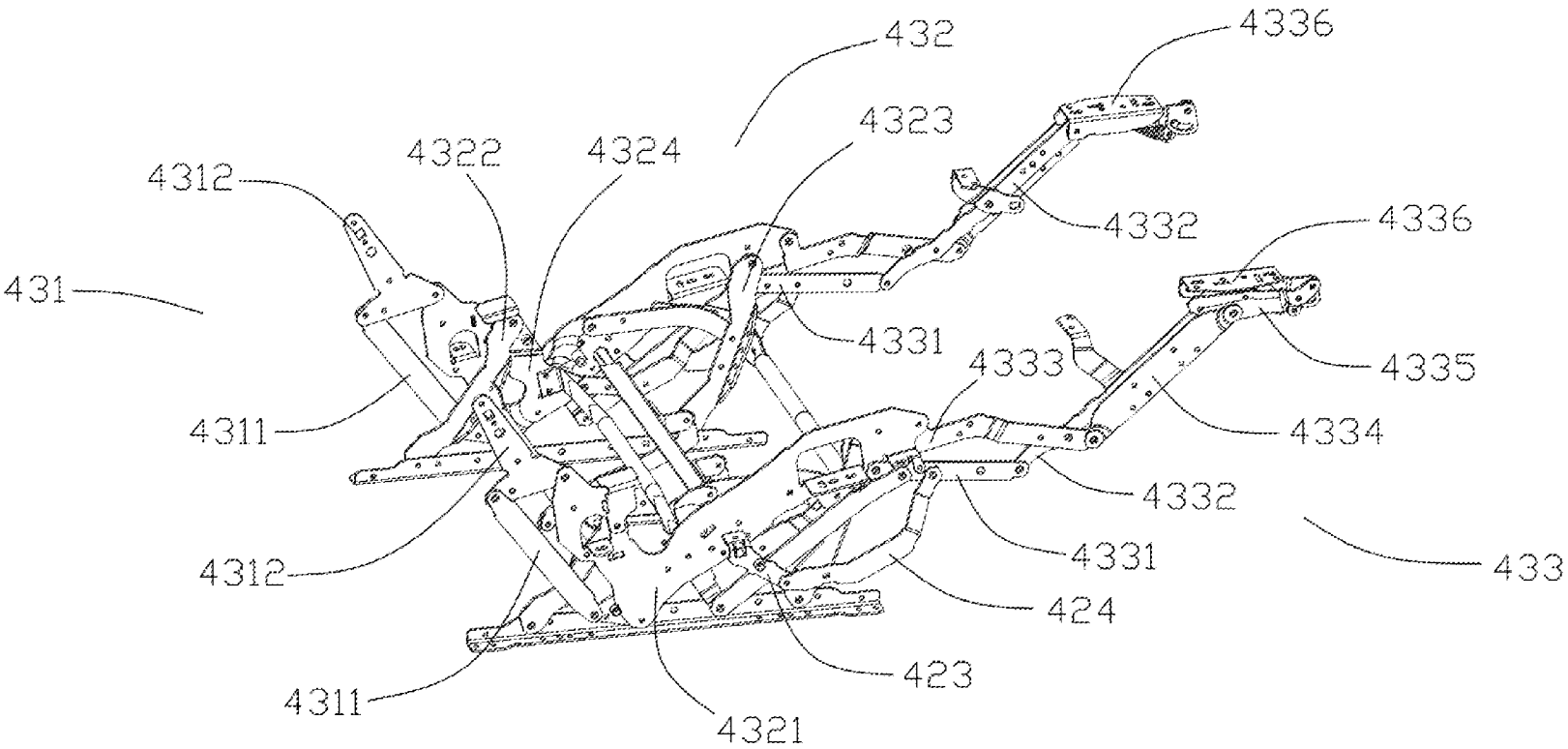
FIG. 10 is a schematic structural diagram of the functional rack in FIG. 8 in a state of leisure posture.
Figure 11:
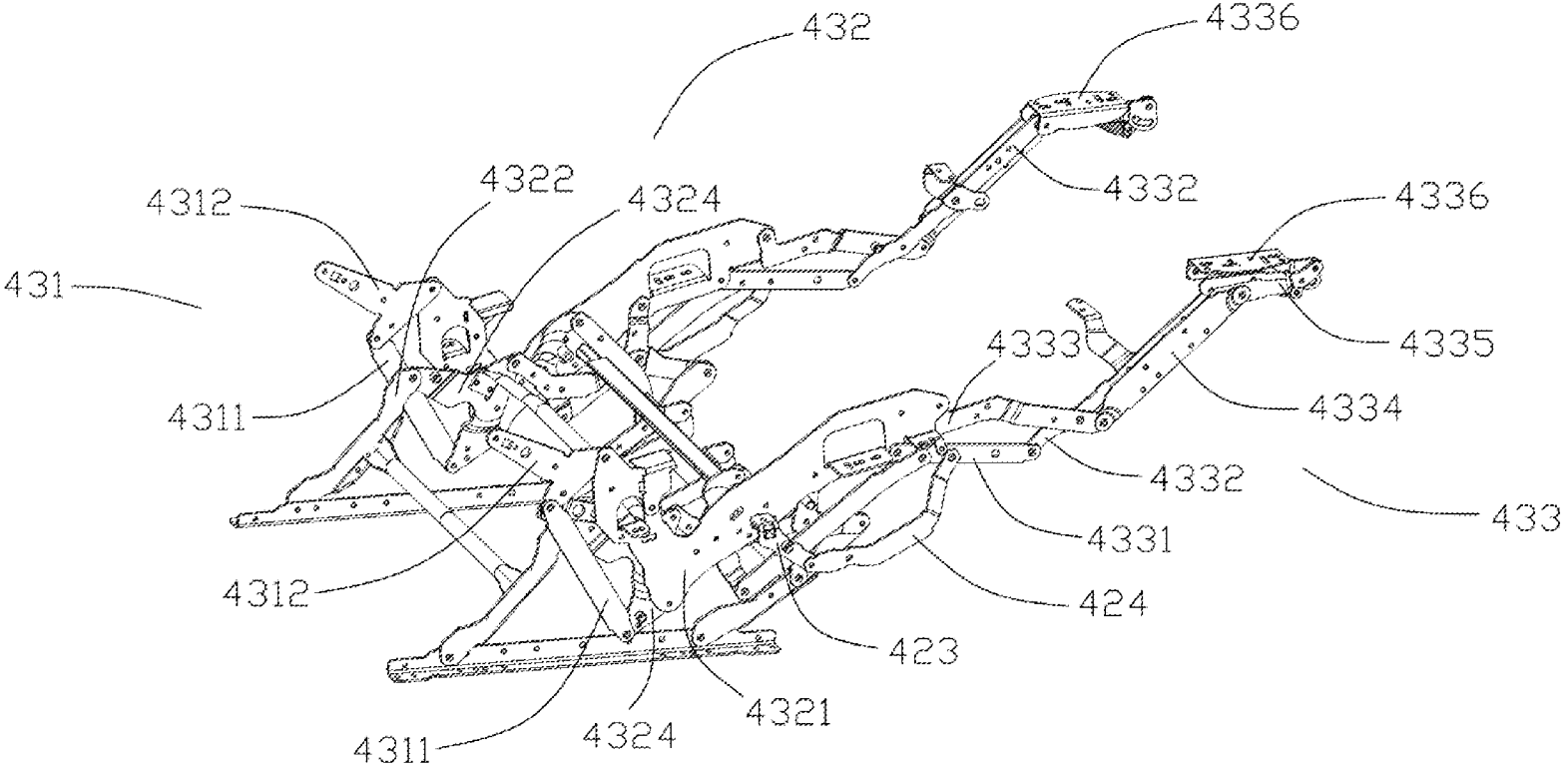
FIG. 11 is a schematic structural diagram of the functional rack in FIG. 8 in a state of lying posture.

Referring to FIGS. 9-11, the functional rack 4 further comprises a linkage mechanism 42 for driving the telescopic brackets 43 to extend and retract, the linkage mechanism 42 comprises a first linkage lever 421 and a second linkage lever 422, the first linkage lever 421 comprises a rotating square tube 4211 and a rotating angle iron 4212, the rotating square tube 4211 and the rotating angle iron 4212 are connected. The central position of the rotating square tube 4211 is also provided with a first connecting bracket 42111, and the central position of the second linkage lever 422 is provided with a second connecting bracket (not shown in the figure), both the first connecting bracket 42111 and the second connecting bracket are connected to a driving member (not shown in the figure). The first connecting bracket 42111 and the second connecting bracket generate relative displacement under the driving of the driving member, and the first linkage lever 421 and the second linkage lever 422 are driven to rotate, and further the left and right telescopic brackets 43 are driven to extend and retract.

Referring to FIGS. 9-10, each telescopic bracket 43 comprises a backrest mechanism 431, a seat plate linkage mechanism 432 and a leg extension mechanism 433 connected in sequence. The seat plate linkage mechanism 432 comprises a first supporting piece 4322 and a second supporting piece 4323. One end of the first supporting piece 4322 and one end of the second supporting piece 4323 are rotatably connected with the seat frame mounting plate 4321, and the other end of the first supporting piece 4322 and the other end of the second supporting piece 4323 are rotatably connected with the first underframe 411, thereby forming a four-link mechanism. In addition, the seat plate linkage mechanism 432 further comprises a first seat frame bracket 4324, which is fixedly connected to the seat frame mounting plate 4321. Two ends of the second linkage lever 422 are connected to the left and right first seat frame brackets 4324, respectively.

In addition, the backrest mechanism 431 further comprises a first back bar 4311 and a second mounting plate 4312 for mounting the sofa backrest 6, one end of the first back bar 4311 is rotatably connected to the second mounting plate 4312, and the other end is rotatably connected to the first seat frame bracket 4324; the other end of the second mounting plate 4312 is rotatably connected to the seat frame mounting plate 4321.

Therefore, when the driving member drives the second linkage lever 422 to rotate, the first seat frame bracket 4324 can be driven to rotate, and then the first back bar 4311 and the second mounting plate 4312 can be driven to rotate, and finally the backrest mechanism 431 can be tilted forward or backward.

In addition, the leg extension mechanism 433 comprises a first foot bar 4331, a second foot bar 4332, a third foot bar 4333, a fourth foot bar 4334, a fifth foot bar 4335, and a third mounting plate 4336 for mounting the sofa foot pad plate 7. One end of the first foot bar 4331 is rotatably connected to one side face of the seat frame mounting plate 4321, the other end is rotatably connected to the second foot bar 4332, one end of the fifth foot bar 4335 is rotatably connected to the second foot bar 4332, and the other end is rotatably connected to the third mounting plate 4336; one end of the third foot bar 4333 is rotatably connected to the other side face of the seat frame mounting plate 4321, and the other end is rotatably connected to the fourth foot bar 4334; the other end of the fourth foot bar 4334 is also rotatably connected to the fifth foot bar 4335. In addition, the leg extension mechanism also comprises a first driving bracket 423 and a second driving bracket 424. One end of the first driving bracket 423 is fixedly connected to the rotating square tube 4211, and the other end is rotatably connected to the second driving bracket 424. The other end of the second driving bracket 424 is rotatably connected to the first foot bar 4331.

As such, when the driving member drives the first linkage lever 421 to rotate, the rotating square tube 4211 and the rotating angle iron 4212 can be simultaneously driven to rotate, thus driving the first driving bracket 423, the second driving bracket 424, the first foot bar 4331, the second foot bar 4332, the third foot bar 4333, the fourth foot bar 4334 and the fifth foot bar 4335 to rotate, and finally driving the third mounting plate 4336 to rotate, thus realizing the extension and retraction motion of the leg extension mechanism 433.

Referring to FIG. 9, the functional rack 4 is further provided with at least one balance bar 44, and two ends of the balance bar 44 are fixedly connected to the left and right first supporting pieces 4322 respectively. In this embodiment, the balance bar 44 is a circular tube. In other embodiments, the balance bar 44 can also be a square tube or other shaped bar. Therefore, by arranging the balance bar 44, the stability of the sofa can be enhanced, and the force balancing effect of the telescopic brackets 43 on the left and right sides of the sofa can be ensured.

Referring to FIG. 10, the functional rack 4 is further provided with at least one anti-torsion bar 45, and two ends of the anti-torsion bar 45 are fixedly connected to the left and right second supporting pieces 4323 respectively. In this embodiment, the anti-torsion bar 45 is a circular tube. In other embodiments, the anti-torsion bar 45 can also be a square tube or other shaped bar. As a result, by arranging the anti-torsion bar 45, it is possible to prevent the telescopic brackets 43 on the two sides from twisting and being unevenly stressed on the two sides during extending or retracting.

Referring again to FIGS. 9-11, which are schematic diagrams showing the functional rack 4 of the present invention in three states: state of sitting posture, state of leisure posture and state of lying posture respectively. As shown in FIG. 9, when the functional rack 4 is in the state of sitting posture, the telescopic brackets 43 are in a retracted state, and the backrest mechanisms 431 and the leg extension mechanisms 433 are retracted toward the middle. As shown in FIG. 10, when the functional rack 4 is in the state of leisure posture, the backrest mechanisms 431 are kept at the same angle as in the state of sitting posture, while the leg extension mechanisms 433 extend forward. As shown in FIG. 11, when the functional rack 4 is in the state of lying posture, the backrest mechanisms 431 are tilted backward, while the leg extension mechanisms 433 are kept in the same state as in the state of leisure posture.

Referring to FIGS. 12-14, which are schematic diagrams showing the functional sofa base assembly of the present invention in three states of sitting posture, leisure posture and lying posture respectively.

Embodiment 4

Referring to FIGS. 15-18, the invention also provides a sofa comprising the sofa base assembly of Embodiment 2, a seat cushion and sofa fabric (not shown in the figure) wrapping the seat cushion, sofa armrests 5, a sofa backrest 6 and a sofa foot pad plate 7. The edge of the sofa fabric is provided with a clamping strip which is clamped with the lower edges of the first side plates 112 of the two longitudinal beams 11 and the lower edges of the third side plates 122 of the two cross beams 12. Therefore, the installation process is simple and convenient, not only is the installation efficiency improved, but also the disassembly is convenient, the fault tolerance rate is high, and material waste cannot be caused.

In addition, the sofa is further provided with a second connecting piece 81, and the sofa backrest is detachably connected with the sofa seat frame 1 through the second connecting piece 81. In the present embodiment, there are two second connecting pieces 81, which are symmetrically arranged on the two longitudinal beams 11. Each second connecting piece 81 comprises a fourth supporting plate 811 and a sixth side plate 812 connected with the fourth supporting plate 811. Specifically, the second connecting piece 81 is substantially L-shaped, the fourth supporting plate 811 is parallel to the horizontal plane, and the sixth side plate 812 is perpendicular to the fourth supporting plate 811. Preferably, the fourth supporting plate 811 and the sixth side plate 812 are integrally formed by bending. At the same time, the fourth supporting plate 811 and the sixth side plate 812 are formed by bending the same steel plate in order to facilitate processing and maintain the relatively high supporting strength of the second connecting piece 81. It should be noted that the fourth supporting plate 811 and the sixth side plate 812 are not limited to the integrally formed structure, and can also be fixed by welding.

Specifically, the fourth supporting plate 811 is connected to the first supporting plate 111 of the longitudinal beam 11, and the sixth side plate 812 is connected to the sofa backrest 6. In this embodiment, the fourth supporting plate 811 and the first supporting plate 111 are fixed by means of bolts or screws, and the sixth side plate 812 and the sofa backrest 6 are fixed by means of bolts or screws.

Therefore, the fourth supporting plate 811 is arranged to be connected with the first supporting plate 111, so that the supporting strength of the sofa base assembly to the sofa backrest 6 is improved, and the sofa backrest 6 is stabler and firmer.

In addition, the sofa is also provided with a third connecting piece 82, and the sofa foot pad plate 7 is detachably connected to the supporting leg 31 through the third connecting piece 82. In the present embodiment, there are two third connecting pieces 82 which are symmetrically arranged on the two supporting legs 31. Each third connecting piece 82 comprises a fifth supporting plate 821 and a seventh side plate 822 connected with the fifth supporting plate 821. Specifically, the third connecting piece 82 is substantially L-shaped. Preferably, the fifth supporting plate 821 and the seventh side plate 822 are integrally formed by bending. The fifth supporting plate 821 and the seventh side plate 822 are formed by bending the same steel plate in order to facilitate processing and maintain the relatively higher supporting strength of the third connecting piece 82. It should be noted that the fifth supporting plate 821 and the seventh side plate 822 are not limited to the integrally formed structure, and can also be fixed by welding.

Figure 17:
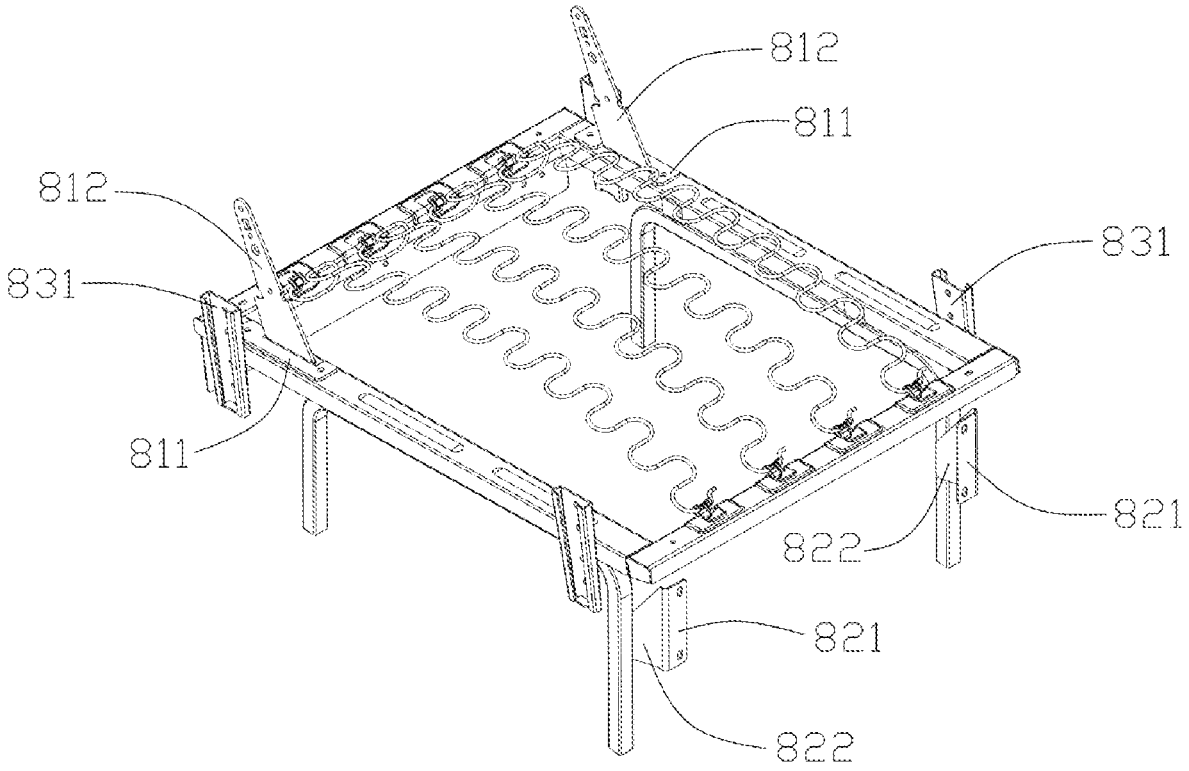
FIG. 17 is a schematic structural diagram of the sofa with sofa armrests, a sofa backrest and a sofa foot pad plate removed according to Embodiment 4 of the present invention.
Figure 18:
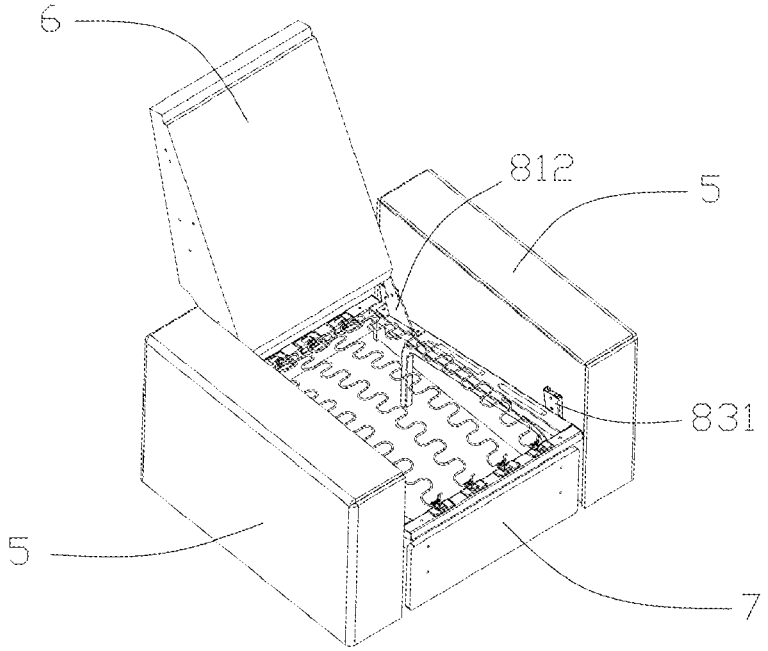
FIG. 18 is a structural schematic diagram of the sofa according to Embodiment 4 of the present invention.
Figure 19:
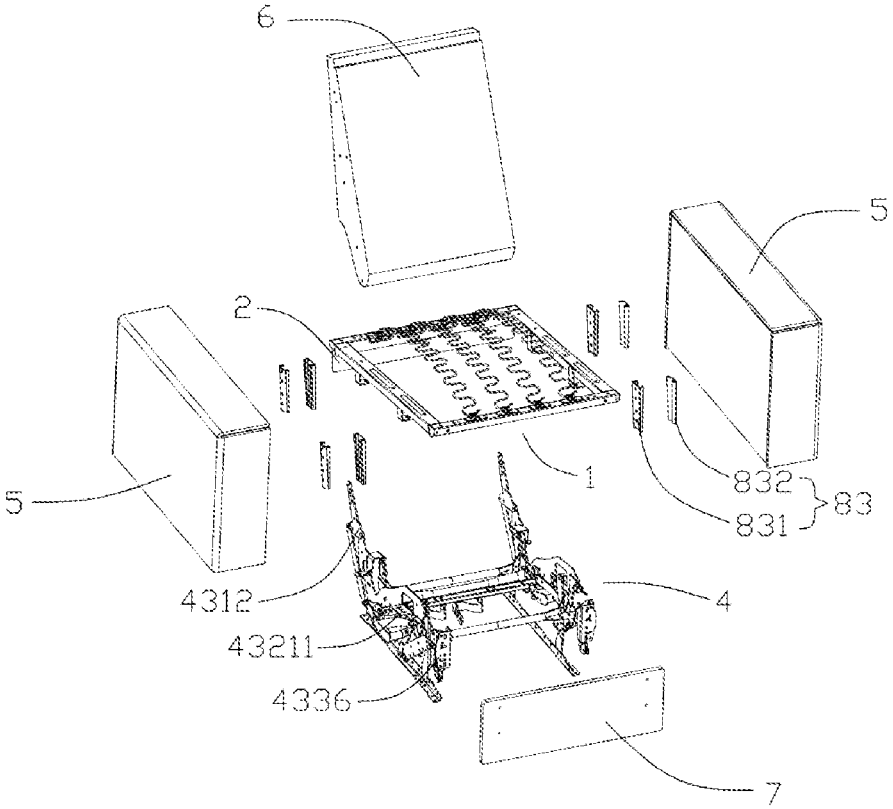
FIG. 19 is an explosion schematic view of a functional sofa according to Embodiment 5 of the present invention.

Referring to FIG. 17, the seventh side plate 822 is connected to the side face of the supporting leg 31 facing the inside of the sofa seat frame 1, and the fifth supporting plate 821 is detachably connected to the sofa foot pad plate 7. In this embodiment, the seventh side plate 822 and the supporting leg 31 are fixed by welding, and the fifth supporting plate 821 and the sofa foot pad plate 7 are fixed by bolts or screws.

Therefore, the fifth supporting plate 821 is arranged to be connected with the sofa foot pad plate 7, so that the supporting strength of the sofa base assembly to the sofa foot pad plate 7 is improved, and the sofa foot pad plate 7 is stabler and firmer.

In addition, the sofa further comprises fourth connecting pieces 83 through which the sofa armrest 5 is detachably connected to the sofa seat frame 1. Each fourth connecting piece 83 comprises a first member 831 and a second member 832, and the first member 831 is in sliding insertion fit with the second member 832. In this embodiment, the first members 831 are connected to the longitudinal beams 11, and the second members 832 are connected to the sofa armrests 5. Admittedly, in other embodiments, the first members 831 can be connected to the sofa armrests 5 and the second members 832 can be connected to the longitudinal beams 11.

Figure 16:
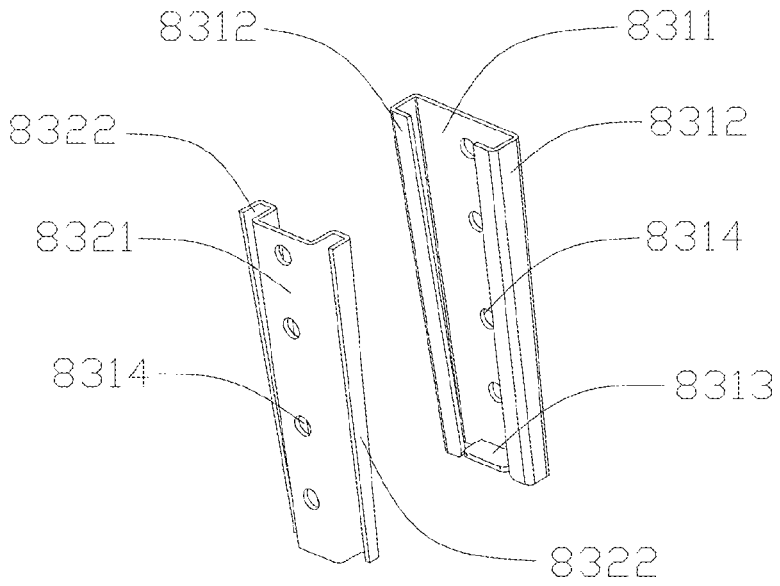
FIG. 16 is a structural schematic diagram of a fourth connecting piece of the sofa according to Embodiment 4 of the present invention.

Referring to FIG. 16, the first member 831 comprises a first substrate 8311, two guide rails 8312 arranged at intervals on the first substrate 8311, and a stopper 8313 arranged on the first substrate 8311 and located under the two guide rails 8312, the first substrate 8311 is connected to the first side plate 112 of the longitudinal beam 11; the second member 832 comprises a second substrate 8321 and two guide bars 8322 arranged at intervals on the second substrate 8321, the second substrate 8321 is connected to the side face of the sofa armrest 5; the two guide bars 8322 are respectively in sliding insertion fit with the two guide rails 8312.

Specifically, the first substrate 8311 is in a strip-shaped plate shape, and the guide rail 8312 is of a first bent structure formed by bending the side edge of the first substrate 8311 toward one surface of the first substrate 8311; the stopper 8313 is of a second bent structure formed by bending one side edge of the first substrate 8311 near the end toward one surface of the first substrate 8311; both the first bent structure and the second bent structure are bent toward the same surface of the first substrate 8311.

In this embodiment, the first bent structure is bent two times and is in an L shape; the second bent structure is bent one time. Admittedly, in other embodiments, the first and second bent structures can be in other shapes; at the same time, the two guide rails 8312 may not be limited to the integrally bending formed structure, and can also be fixed to the first substrate 8311 by welding.

Specifically, the second substrate 8321 is also in a strip-shaped plate shape, and the guide bar 8322 is of a third bent structure formed by bending the side edge of the second substrate 8321 toward one surface of the second substrate 8321.

In this embodiment, the third bent structure is bent three times and is in the shape of "II"; admittedly, in other embodiments, the third bent structure can be in other shapes. At that same time, the two guide bars 8322 may not be limited to the integrally bending formed structure, and can also be fixed to the second substrate 8321 by welding.

Further, the width between the two guide rails 8312 gradually decreases in the axial direction of the first substrate 8311, and the width between the two guide bars 8322 gradually decreases in the axial direction of the second substrate 8321. As a result, when the two guide bars 8322 are inserted into the two guide rails 8312, the guide bars and the guide rails are in tighter fit, thereby improving the stability of the assembly of the sofa armrest 5.

In addition, the first substrate 8311 and the second substrate 8321 are each provided with a plurality of bolt holes 8314 which are uniformly arranged in the axial direction of the first substrate 8311 and the second substrate 8321, respectively. The first member 831 and the second member 832 are positioned via the bolt holes 8314 and connected by bolts.

Therefore, after the first member 831 and the second member 832 are in sliding insertion fit, the first member 831 and the second member 832 are fixed by two methods: one is to abut the two guide bars 8322 of the second member 832 against the stopper 8313 of the first member 831; and the other is to align the bolt holes 8314 in the first substrate 8311 of the first member 831 with the bolt holes 8314 in the second substrate 8321 of the second member 832, and then complete connection with bolts. The two fixing methods are adopted to improve the flexibility of the assembly of the sofa armrest 5.

In addition, in this embodiment, the sofa armrests 5, the sofa backrest 6 and the sofa foot pad plate 7 are all integrally formed by a blow molding process. Therefore, the sofa armrests 5, the sofa backrest 6 and the sofa foot pad plate 7 made by the blow molding process not only ensure the required strength, but also reduce the weight and improve the production efficiency.

The sofa production and assembly process in the embodiment specifically comprises the following steps:

producing cross beams 12 and longitudinal beams 11 according to the defined dimensions and assembling the two cross beams 12 and the two longitudinal beams 11 to form the sofa seat frame 1;

installing a plurality of serpentine springs between the two cross beams 12 of the sofa seat frame 1 to form a cushion supporting structure;

producing first connecting pieces 14 according to defined dimensions, and connecting the two fifth side plates 142 of each first connecting piece 14 with the first side plate 112 and the second side plate 113 of the longitudinal beam 11, respectively, to realize the connection of the first connecting pieces 14 with the sofa seat frame 1;

producing supporting legs 31 according to the defined dimensions to obtain a rack 3;

connecting the third supporting plates 141 of the first connecting pieces 14 to the supporting legs 31 to realize the connection of the sofa seat frame 1 with the rack 3 to obtain the sofa seat assembly;

placing a seat cushion on the seat cushion supporting structure;

processing the sofa fabric to set dimensions, and fixing a clamping strip on the edge of the sofa fabric, then wrapping the seat cushion with the sofa fabric, and clamping the sofa fabric with the lower edges of the first side plates 112 of the two longitudinal beams 11 and the lower edges of the third side plates 122 of the two cross beams 12 through the clamping strip on the sofa fabric, so as to fix the sofa fabric to the sofa seat frame 1, thus completing the production and assembly of the seat cushion; and installing the sofa armrests 5 and the sofa backrest 6 on the sofa seat frame 1, and installing the sofa foot pad plate 7 on the supporting legs 31, thus completing the production and assembly of the sofa.

Embodiment 5

Referring to FIGS. 19-22, the invention also provides a functional sofa comprising the functional sofa base assembly of Embodiment 3, a seat cushion and sofa fabric (not shown in the figure) wrapping the seat cushion, sofa armrests 5, a sofa backrest 6, and a sofa foot pad plate 7. Wherein, the edge of the sofa fabric is provided with a clamping strip, and the sofa fabric is detachably connected with the lower edges of the first side plates 112 of the two longitudinal beams 11 and the lower edges of the third side plates 122 of the two cross beams 12 through the clamping strip. In this embodiment, the structure, number and installation position of the clamping strip are the same as those in Embodiment 4, and will not be repeated here.

In addition, the backrest mechanism 431 of each telescopic bracket 43 comprises a second mounting plate 4312 for mounting the sofa backrest 6, which is detachably connected to the functional rack 4 through the second mounting plates 4312. In the present embodiment, the sofa backrest 6 and the second mounting plates 4312 are connected by means of bolts or screws.

In addition, the leg extension mechanism 433 of each telescopic bracket 43 comprises a third mounting plate 4336 for mounting the sofa foot pad plate 7, which is detachably connected to the functional rack 4 through the third mounting plates 4336. In this embodiment, the sofa foot pad plate 7 and the third mounting plates 4336 are connected by bolts.

In addition, the functional sofa further comprises fourth connecting pieces 83 through which the sofa armrest 5 is detachably connected to the sofa seat frame 1. In the present embodiment, the structure, number and installation position of the fourth connecting pieces 83 are the same as those in Embodiment 4, and will not be repeated here.

In addition, in this embodiment, the sofa armrests 5, the sofa backrest 6 and the sofa foot pad plate 7 are all integrally formed by a blow molding process.

Figure 20:
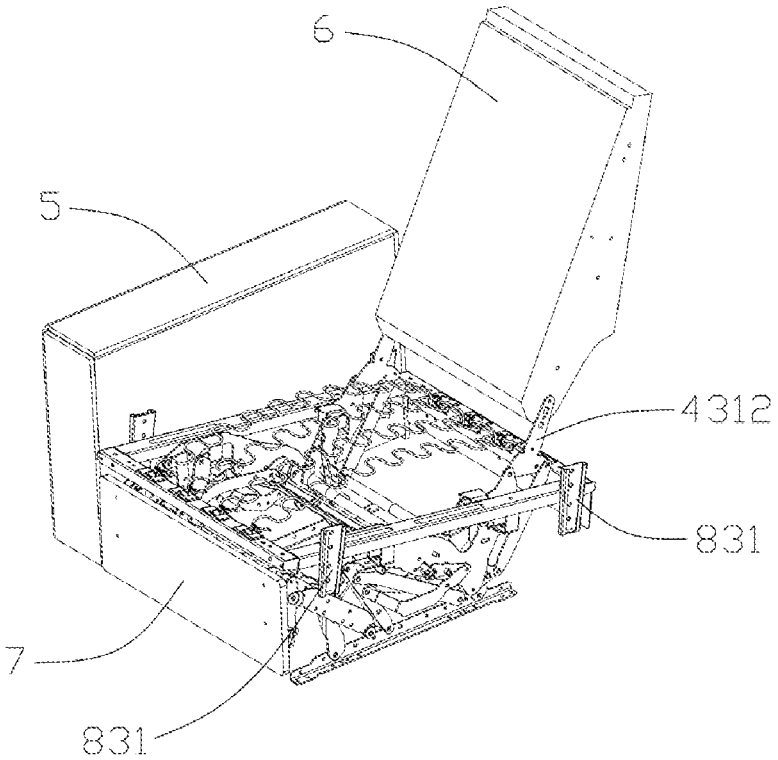
FIG. 20 is a structural schematic diagram of the functional sofa (with the right sofa armrest removed) in a state of sitting posture according to Embodiment 5 of the present invention.
Figure 21:
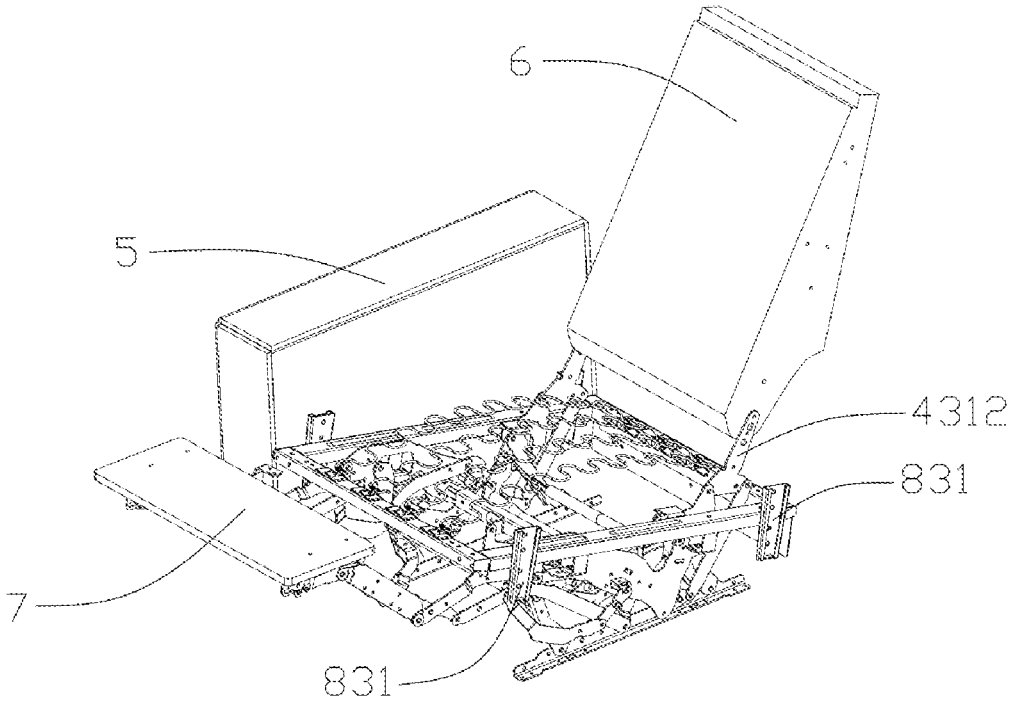
FIG. 21 is a schematic structural diagram of the functional sofa (with the right sofa armrest removed) in a state of leisure posture according to Embodiment 5 of the present invention.
Figure 22:
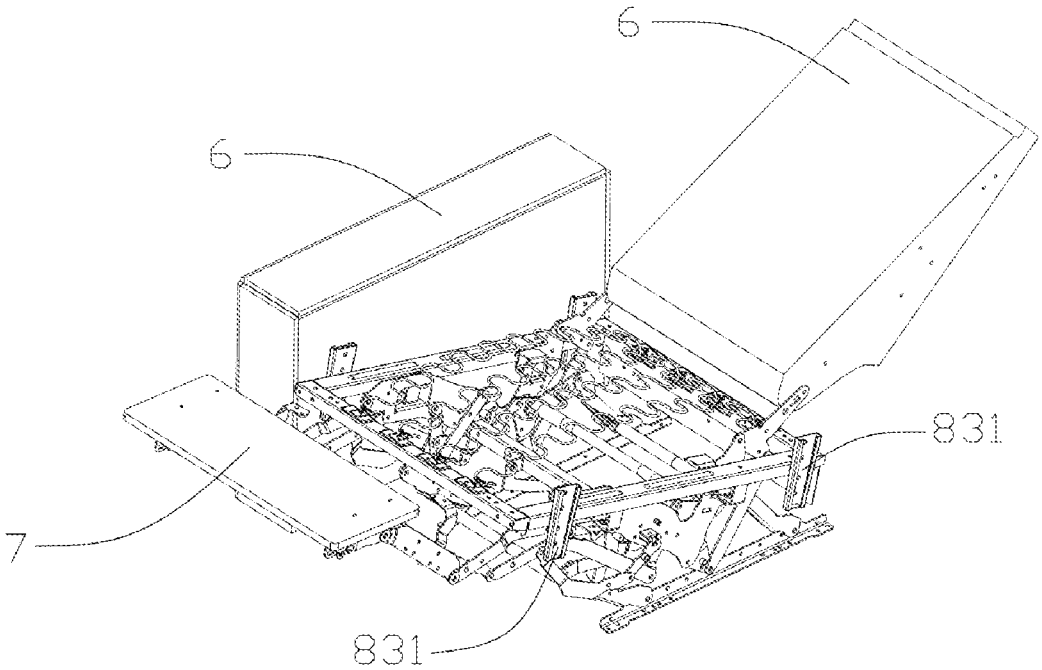
FIG. 22 is a structural schematic diagram of the functional sofa (with the right sofa armrest removed) in a state of lying posture according to Embodiment 5 of the present invention.

Referring to FIGS. 20-22, which are schematic diagrams showing the functional sofa (with the right sofa armrest removed) of the present invention in three states of sitting posture, leisure posture and lying posture respectively.

The functional sofa production and assembly process in the embodiment comprises the following steps:

producing cross beams 12 and longitudinal beams 11 according to the defined dimensions and assembling the two cross beams 12 and the two longitudinal beams 11 to form a sofa seat frame 1;

installing a plurality of serpentine springs between the two cross beams 12 of the sofa seat frame 1 to form a cushion supporting structure;

producing first connecting pieces 14 according to defined dimensions, and connecting the two fifth side plates 142 of each first connecting piece 14 to the first side plate 112 and the second side plate 113 of the longitudinal beam 11, respectively, to realize the connection of the first connecting pieces 14 with the sofa seat frame 1;

producing parts of a functional rack 4 according to defined dimensions and assembling the parts to obtain the functional rack 4;

connecting the third supporting plates 141 of the first connecting pieces 14 to the first mounting plates 43211 of the telescopic brackets 43 to realize the connection of the sofa seat frame 1 with the functional rack 4 to obtain a functional sofa base assembly; and placing a seat cushion on the seat cushion supporting structure;

processing the sofa fabric to set dimensions, and fixing a clamping strip on the edge of the sofa fabric, then wrapping the seat cushion with the sofa fabric, and clamping the sofa fabric with the lower edges of the first side plates 112 of the two longitudinal beams 11, the lower edges of the third side plates 122 of the cross beams 12 close to a sofa foot pad plate 7 and the lower edge of an extension plate 2 on the cross beams 12 close to a sofa backrest 6 through the clamping strip on the sofa fabric, so as to fix the sofa fabric to the sofa seat frame 1, thus completing the production and assembly of the seat cushion; and installing the sofa backrest 6 and the sofa foot pad plate 7 on the telescopic brackets 43, and installing the sofa armrests 5 on the supporting legs 31, thus completing the production and assembly of the sofa.

Embodiment 6

Figure 23:
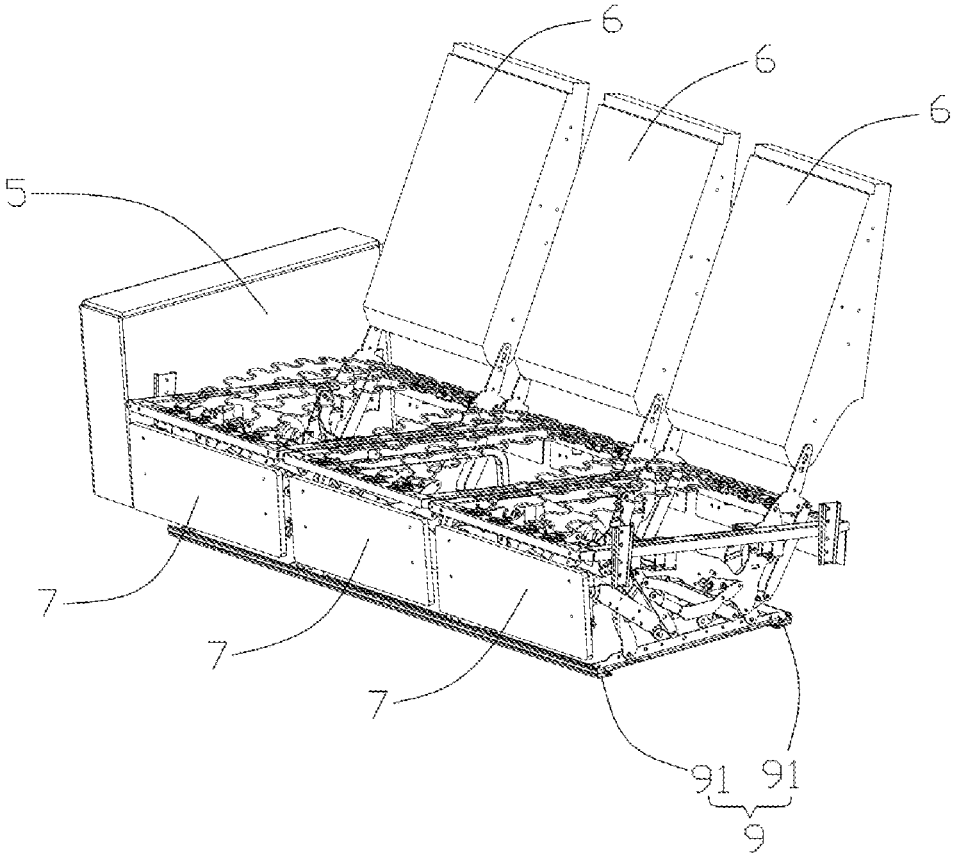
FIG. 23 is a schematic structural diagram of a three-seater sofa (with the right sofa armrest of the functional sofa in the right position removed) in a state of sitting posture according to Embodiment 6 of the present invention.
Figure 24:
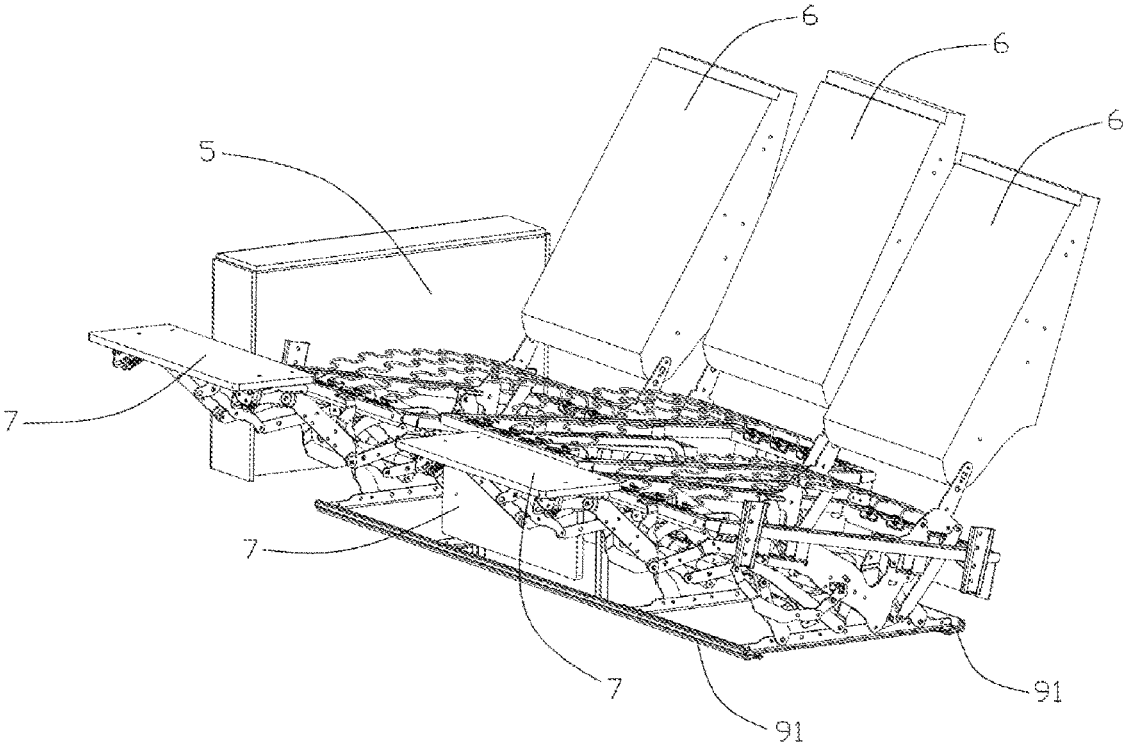
FIG. 24 is a schematic structural diagram of a three-seater sofa (with the right sofa armrest of the functional sofa in the right position removed) in a state of leisure posture according to Embodiment 6 of the present invention.
Figure 25:
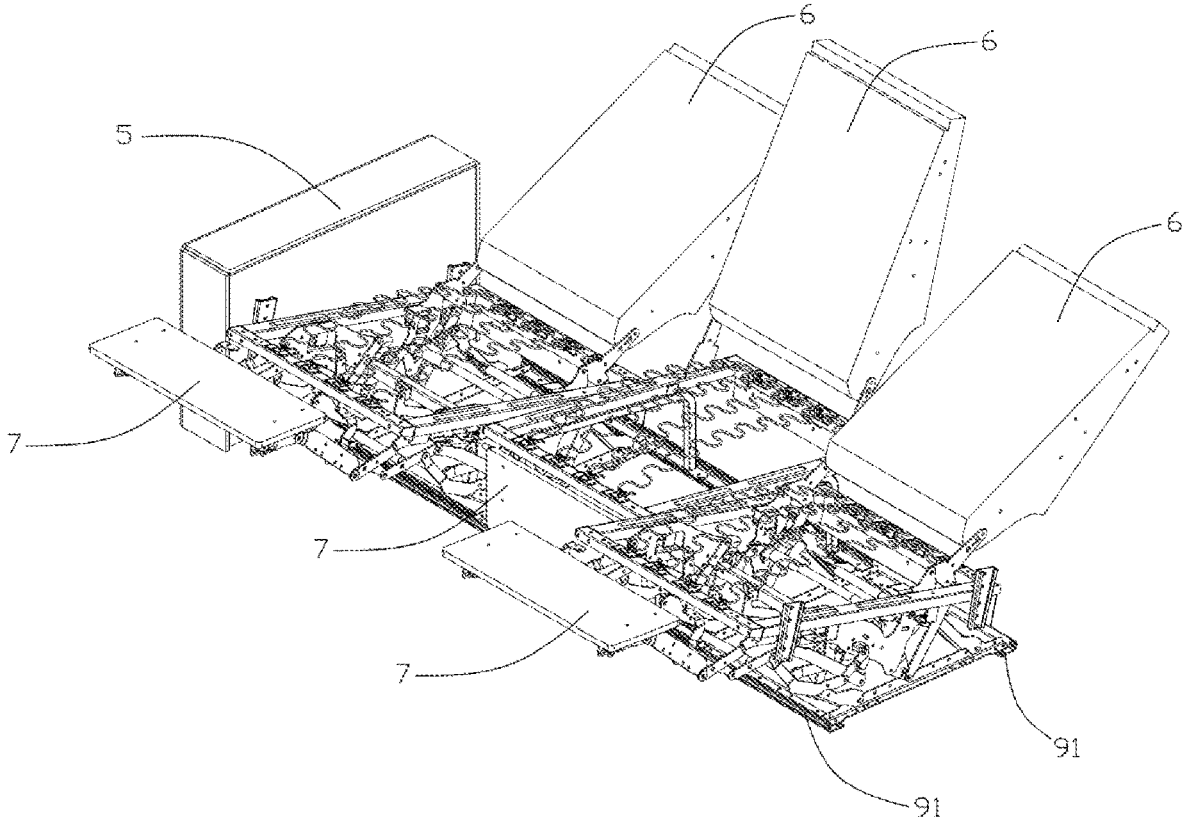
FIG. 25 is a schematic structural diagram of a three-seater sofa (with the right sofa armrest of the functional sofa in the right position removed) in a state of lying posture according to Embodiment 6 of the present invention.

Referring to FIGS. 23-25, the invention also provides a three-seater sofa, which comprises the sofa in Embodiment 4, the functional sofa in Embodiment 5 and a second base 9, wherein the sofa is arranged in the middle position, and the functional sofa is respectively arranged in the left position and the right position (the functional sofa in the left position has no right armrest, and the functional sofa in the right position has no left armrest). The second base 9 is formed by two strip-shaped second underframes 91 arranged in parallel, and the second underframes 91 are perpendicular to the two first underframes 411 of the first base 41.

Specifically, the two second underframes 91 are connected to two ends of the first underframes 411 and two ends of the supporting legs 31, respectively. In the present embodiment, the second underframes 91, the first underframes 411 and the support legs 31 are fixed by bolts or screws.

Referring to FIGS. 23-25, which are schematic diagrams showing the three-seater sofa (with the right sofa armrest of the functional sofa in the right position removed) of the present invention in three states of sitting posture, leisure posture and lying posture respectively.

The technical means disclosed in the scheme of the invention are not limited to the technical means disclosed in the above embodiment, but also include a technical scheme composed of any combination of the above technical features. It should be noted that for those of ordinary skill in the art, a number of modifications and embellishments may be made without departing from the principles of the present invention, and these modifications and embellishments are also considered to be the scope of protection of the present invention.

The invention claimed is:

1. A sofa seat frame, characterized by comprising two cross beams (12) arranged at intervals and two longitudinal beams (11) connecting the two cross beams (12), wherein:

a plurality of supporting elastic pieces (13) are arranged between the two cross beams (12); and each longitudinal beam (11) comprises a first supporting plate (111) for supporting a seat cushion and a first side plate (112) arranged at one side of a lower part of the first supporting plate (111) and used for being detachably connected with a sofa fabric on the seat cushion;

each longitudinal beam (11) is a metal piece and comprises a second side plate (113) arranged at a distance from the first side plate (112) and located on an other side of the lower part of the first supporting plate (111), and the first supporting plate (111) connecting the first side plate (112) with the second side plate (113) from a top of the first side plate (112) and a top of the second side plate (113);

further comprising a first connecting piece (14) for being connected with a sofa rack, the first connecting piece (14) comprising two fifth side plates (142) arranged at intervals and a third supporting plate (141) connecting bottoms of the two fifth side plates (142), wherein:

the third supporting plate (141) is connected with the sofa rack; and one fifth side plate (142) is connected to the first side plate (112) of the longitudinal beam (11), and another fifth side plate (142) is connected to the second side plate (113) of the longitudinal beam (11).

2. The sofa seat frame according to claim 1, characterized in that the third supporting plate (141) and the two fifth side plates (142) are integrally formed by bending, and are U-shaped.

3. The sofa seat frame according to claim 1, characterized in that the first side plate (112), the second side plate (113) and the first supporting plate (111) are integrally formed by bending, and are inverted U-shaped.

4. The sofa seat frame according to claim 1, characterized in that the first supporting plate (111) is provided with a reinforcing rib (1111).

5. The sofa seat frame according to claim 1, characterized in that the two cross beams (12) are each provided with a plurality of hooks (125) which are integrally formed by stamping; one ends of the supporting elastic pieces (13) are connected to the hooks (125) on one cross beam (12), and other ends of the supporting elastic pieces (13) are connected to the corresponding hooks (125) on the other cross beam (12).

6. The sofa seat frame according to claim 5, characterized in that each hook (125) is provided with a protrusion (1251) for preventing unhooking of the supporting elastic piece (13).

7. The sofa seat frame according to claim 5, characterized in that each cross beam (12) is a metal piece and comprises a second supporting plate (121), a third side plate (122) arranged on an outer side of a lower part of the second supporting plate (121) and used for being detachably connected with the sofa fabric on the seat cushion, and a fourth side plate (123) arranged on an inner side of the lower part of the second supporting plate (121), wherein:

a plurality of hooks (125) on each cross beam (12) are formed by stamping the second supporting plate (121) and the fourth side plate (123).

8. The sofa seat frame according to claim 7, characterized in that the third side plate (122), the fourth side plate (123) and the second supporting plate (121) are integrally formed by bending, and are inverted U-shaped.

9. The sofa seat frame according to claim 7, characterized in that two ends of each cross beam (12) are also provided with reinforcing plates (124), and the reinforcing plates (124) are connected with the third side plate (122) and the fourth side plate (123).

10. A sofa base assembly, characterized by comprising a rack (3) and the sofa seat frame (1) detachably connected to the rack (3) according to claim 1, wherein:

the rack (3) comprises two metal supporting legs (31) arranged opposite to each other; and a third supporting plate (141) of the sofa seat frame (1) is detachably connected to the supporting legs (31).

11. A sofa, characterized by comprising the sofa base assembly according to claim 10, a seat cushion and sofa fabric wrapping the seat cushion, a sofa armrest (5), a sofa backrest (6) and a sofa foot pad plate (7), wherein the sofa fabric, the sofa armrest (5) and the sofa backrest (6) are all detachably connected with the sofa seat frame (1), and the sofa foot pad plate (7) is detachably connected with the supporting legs (31).

12. The sofa according to claim 11, characterized in that an edge of the sofa fabric is provided a clamping strip, and the sofa fabric is clamped with lower edges of the first side plates (112) of the two longitudinal beams (11) through the clamping strip.

13. The sofa according to claim 11, characterized by further comprising a fourth connecting piece (83), wherein the fourth connecting piece (83) comprises a first member (831) connected to the first side plate (112) of the longitudinal beam (11) and a second member (832) connected to the sofa armrest (5), and the first member (831) and the second member (832) are in sliding insertion fit;

or, the first member (831) is connected to the sofa armrest (5), the second member (832) is connected to the first side plate (112) of the longitudinal beam (11), and the first member (831) and the second member (832) are in sliding insertion fit.

14. The sofa according to claim 13, characterized in that the first member (831) comprises a first substrate (8311), two guide rails (8312) arranged at intervals on the first substrate (8311), and a stopper (8313) arranged on the first substrate (8311) and located under the two guide rails (8312); the second member (832) comprises a second substrate (8321) and two guide bars (8322) arranged at intervals on the second substrate (8321), and the two guide bars (8322) are respectively in sliding insertion fit with the two guide rails (8312).

15. A sofa production and assembly process, characterized by comprising the following steps:

producing cross beams (12) and longitudinal beams (11) according to defined dimensions, and assembling the two cross beams (12) and the two longitudinal beams (11) to form a sofa seat frame (1);

installing a plurality of serpentine springs between the two cross beams (12) of the sofa seat frame (1) to form a seat cushion supporting structure;

producing a plurality of first connecting pieces (14) according to defined dimensions, wherein each first connecting piece (14) comprises two symmetrically arranged fifth side plates (142) and a third supporting plate (141) connecting bottoms of the two fifth side plates (142), the two fifth side plates (142) of each of the plurality of the first connecting pieces (14) are connected with the longitudinal beams (11) to realize the connection of the plurality of first connecting pieces (14) with the sofa seat frame (1);

producing two supporting legs (31) according to defined dimensions to obtain a rack (3);

connecting the third supporting plates (141) of the first connecting pieces (14) with the supporting legs (31) to realize the connection of the sofa seat frame (1) with the rack (3) to obtain a sofa base assembly; and completing the production and assembly of the sofa according to the obtained sofa base assembly.

16. The sofa production and assembly process according to claim 15, characterized in that the step of "completing the production and assembly of the sofa according to the obtained sofa base assembly" further comprises the following steps:

placing a seat cushion on the seat cushion supporting structure;

processing a sofa fabric to set dimensions, and fixing a clamping strip on an edge of the sofa fabric, then wrapping the seat cushion with the sofa fabric, and fixing the sofa fabric to the sofa seat frame (1) via the clamping strip on the sofa fabric, thus completing the production and assembly of the seat cushion; and installing a sofa armrest (5) and a sofa backrest (6) on the sofa seat frame (1), and installing a sofa foot pad plate (7) on the supporting legs (31), thus completing the production and assembly of the sofa.

* * * * *